US011499292B2

(12) United States Patent
Velde et al.

(10) Patent No.: US 11,499,292 B2
(45) Date of Patent: Nov. 15, 2022

(54) MAGNETORHEOLOGICAL FLUID JOYSTICK SYSTEMS REDUCING WORK VEHICLE MISPOSITIONING

(71) Applicant: Deere & Company, Moline, IL (US)

(72) Inventors: Todd F. Velde, Dubuque, IA (US); Madeline T. Oglesby, Asbury, IA (US); Lance R. Sherlock, Asbury, IA (US); Benjamin P. Koestler, Asbury, IA (US); Mark D. Anderson, Dubuque, IA (US); Aaron R. Kenkel, East Dubuque, IL (US); Doug M. Lehmann, Durango, IA (US); Craig Christofferson, Dubuque, IA (US); Kenneth Franck, Dubuque, IA (US); Christopher J. Meyer, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 16/864,696

(22) Filed: May 1, 2020

(65) Prior Publication Data

US 2021/0340723 A1 Nov. 4, 2021

(51) Int. Cl.
*E02F 9/20* (2006.01)
*G05G 9/047* (2006.01)
(Continued)

(52) U.S. Cl.
CPC ..... *E02F 9/2004* (2013.01); *E02F 9/2033* (2013.01); *E02F 9/24* (2013.01);
(Continued)

(58) Field of Classification Search
CPC ..... G05G 5/02; G05G 5/12
See application file for complete search history.

(56) References Cited

U.S. PATENT DOCUMENTS 7,197,873 B1 4/2007 Windhorst et al.
8,066,567 B2 11/2011 Waggoner et al.
(Continued)

FOREIGN PATENT DOCUMENTS

CA 1203605 A 4/1986
CN 102027268 B 12/2013
(Continued)

OTHER PUBLICATIONS

Farzad Ahmadkhanlou, Design, Modeling and Control of Magnetorheological Fluid-Based Force Feedback Dampers for Telerobotic Systems, ResearchGate, https://www.researchgate.net/publication/251697638, Apr. 2008. (19 pages).
(Continued)

*Primary Examiner* — Vicky A Johnson
(74) *Attorney, Agent, or Firm* — Klintworth & Rozenblat IP LLP

(57) ABSTRACT

In embodiments, a work vehicle magnetorheological fluid (MRF) joystick system includes a joystick device, an MRF joystick resistance mechanism, and a controller architecture. The joystick device includes, in turn, a base housing, a joystick, and a joystick position sensor. The MRF joystick resistance mechanism is controllable to selectively resist movement of the joystick relative to the base housing. The controller architecture is configured to: (i) when detecting operator rotation of the joystick in an operator input direction, determine whether continued joystick rotation in the operator input direction will misposition the work vehicle in a manner increasing at least one of work vehicle instability and a likelihood of work vehicle collision; and (ii) when determining that continued joystick rotation will misposition the work vehicle, command the MRF joystick resistance mechanism to generate an MRF resistance force deterring continued joystick rotation in the operator input direction.

20 Claims, 8 Drawing Sheets

(51) Int. Cl.

| | |
|---|---|
| ***G05G 5/03*** | (2008.04) |
| ***G05G 5/02*** | (2006.01) |
| ***E02F 9/26*** | (2006.01) |
| ***G05G 5/12*** | (2006.01) |
| ***E02F 9/24*** | (2006.01) |

(52) U.S. Cl.

CPC ..... *E02F 9/265* (2013.01); *G05G 5/02* (2013.01); *G05G 5/03* (2013.01); *G05G 5/12* (2013.01); *G05G 9/047* (2013.01); *G05G 2009/0477* (2013.01); *G05G 2009/04766* (2013.01); *G05G 2505/00* (2013.01)

(56) References Cited

U.S. PATENT DOCUMENTS

| | | | | |
|---|---|---|---|---|
| 8,639,393 | B2 | 1/2014 | Taylor et al. | |
| 8,972,125 | B1 | 3/2015 | Elliott | |
| 9,141,126 | B2 | 9/2015 | Hynes et al. | |
| 9,181,676 | B2 | 11/2015 | Meislahn et al. | |
| 9,341,258 | B1 | 5/2016 | Templin | |
| 9,771,705 | B2 | 9/2017 | Horstman et al. | |
| 9,777,460 | B2 | 10/2017 | Wuisan et al. | |
| 9,777,461 | B2 | 10/2017 | Wuisan et al. | |
| 9,797,114 | B2 | 10/2017 | Maifield et al. | |
| 10,061,343 | B2 | 8/2018 | Fredrickson et al. | |
| 10,066,367 | B1 | 9/2018 | Wang et al. | |
| 10,119,244 | B2 | 11/2018 | Elkins | |
| 10,145,084 | B2 | 12/2018 | Fredrickson | |
| 11,048,330 | B2 | 6/2021 | Eck et al. | |
| 11,086,350 | B2 | 8/2021 | Wakuda et al. | |
| 2001/0052893 | A1 | 12/2001 | Jolly et al. | |
| 2003/0098196 | A1 | 5/2003 | Yanaka | |
| 2004/0221674 | A1 | 11/2004 | Komelson | |
| 2006/0197741 | A1 | 9/2006 | Biggadike | |
| 2011/0005344 | A1 | 1/2011 | Haevescher | |
| 2013/0229272 | A1* | 9/2013 | Elliott | G05G 9/047 340/407.2 |
| 2016/0179128 | A1* | 6/2016 | Guglielmo | B66F 17/006 182/19 |
| 2017/0073935 | A1 | 3/2017 | Friend et al. | |
| 2018/0058039 | A1* | 3/2018 | Fredrickson | E02F 9/2012 |
| 2019/0210854 | A1 | 7/2019 | Eck et al. | |
| 2019/0286237 | A1 | 9/2019 | Eck et al. | |
| 2020/0125132 | A1 | 4/2020 | Wakuda et al. | |
| 2021/0286431 | A1 | 9/2021 | Eck et al. | |
| 2021/0340723 | A1 | 11/2021 | Velde et al. | |
| 2021/0340724 | A1 | 11/2021 | Kenkel et al. | |
| 2021/0340725 | A1 | 11/2021 | Velde et al. | |
| 2021/0340728 | A1 | 11/2021 | Graham et al. | |
| 2021/0341032 | A1 | 11/2021 | Velde et al. | |
| 2021/0341033 | A1 | 11/2021 | Breutzman et al. | |
| 2021/0341960 | A1 | 11/2021 | Kenkel et al. | |

FOREIGN PATENT DOCUMENTS

| | | | |
|---|---|---|---|
| CN | 112267516 | A | 1/2021 |
| DE | 19848191 | A1 | 4/2000 |
| DE | 102004017148 | A1 | 1/2005 |
| DE | 102004041690 | A1 | 3/2005 |
| DE | 112009003181 | T5 | 1/2012 |
| DE | 102012203095 | A1 | 9/2013 |
| DE | 112013001281 | T5 | 7/2019 |
| DE | 102020104810 | A1 | 2/2021 |
| JP | 2014174726 | A | 9/2014 |
| KR | 20190074555 | A | 6/2019 |
| WO | 9642078 | A1 | 12/1996 |
| WO | 2015009161 | A1 | 1/2015 |

OTHER PUBLICATIONS

Deere & Company, John Deere Motor Grader Left Dual Joystick Controls Tutorial, https://www.youtube.com/watch?v=iYxPlxzD8g4&feature=youtu.be&t=25, Mar. 7, 2017. (2 pages).

MRF Damper, FMR-70S-403 Brochure, undated admitted prior art. (3 pages).

Deere & Company, pending U.S. Appl. No. 63/019,083, filed May 1, 2020.

Deere & Company, pending Utility U.S. Appl. No. 16/864,726, filed May 1, 2020.

Deere & Company, pending Utility U.S. Appl. No. 16/864,749, filed May 1, 2020.

Deere & Company, pending Utility U.S. Appl. No. 16/916,800, filed Jun. 3, 2020.

Deere & Company, pending Utility U.S. Appl. No. 16/922,321, filed Jul. 7, 2020.

Deere & Company, pending Utility U.S. Appl. No. 16/989,427, filed Aug. 10, 2020.

Deere & Company, pending Utility U.S. Appl. No. 17/002,052, filed Aug. 25, 2020.

Deere & Company, pending Utility U.S. Appl. No. 17/038,399, filed Sep. 20, 2020.

USPTO, Non-Final Office Action issued in Utility U.S. Appl. No. 17/002,052 dated Nov. 8, 2021.

German Search Report issued in application No. DE102021203807.7 dated Jan. 26, 2022 with English translation (11 pages).

German Search Report issued in application No. DE102021203860.3 dated Jan. 28, 2022 with English translation (11 pages).

USPTO, Non-Final Office Action issued in Utility U.S. Appl. No. 16/864,749 dated Sep. 8, 2022.

* cited by examiner

MAGNETORHEOLOGICAL FLUID JOYSTICK SYSTEMS REDUCING WORK VEHICLE MISPOSITIONING

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to work vehicle magnetorheological fluid (MRF) joystick systems configured to selectively restrict joystick motion to reduce work vehicle mispositioning; that is, positioning a work vehicle in a manner increasing work vehicle instability or a likelihood of work vehicle collision.

BACKGROUND OF THE DISCLOSURE

Joystick devices are commonly utilized to control various operational aspects of work vehicles employed within the construction, agriculture, forestry, and mining industries. For example, in the case of a work vehicle equipped with a boom assembly, an operator may utilize one or more joystick devices to control boom assembly movement and, therefore, movement of a tool or implement mounted to the outer terminal end of the boom assembly. Common examples of work vehicles having such joystick-controlled boom assemblies include excavators, feller bunchers, skidders, tractors (on which modular front end loader and backhoe attachments may be installed), tractor loaders, wheel loaders, and various compact loaders. Similarly, in the case of dozers, motor graders, and other work vehicles equipped with earth-moving blades, an operator may interface with one or more joysticks to control blade movement and positioning. Joystick devices are also commonly utilized to steer or otherwise control the directional movement of the work vehicle chassis itself as in the case of motor graders, dozers, and certain loaders, such as skid steer loaders. Given the prevalence of joystick devices within work vehicles, taken in combination with the relatively challenging, dynamic environments in which work vehicles often operate, a continued demand exists for advancements in the design and function of work vehicle joystick systems, particularly to the extent that such advancements can improve the safety and efficiency of work vehicle operation.

SUMMARY OF THE DISCLOSURE

A work vehicle magnetorheological fluid (MRF) joystick system is disclosed for usage onboard a work vehicle. In embodiments, the work vehicle MRF joystick system includes a joystick device, an MRF joystick resistance mechanism, and a controller architecture. The joystick device includes, in turn, a base housing, a joystick mounted to the base housing and movable with respect thereto, and a joystick position sensor configured to monitor joystick movement relative to the base housing. The MRF joystick resistance mechanism is at least partially integrated into the base housing and is controllable to selectively resist movement of the joystick relative to the base housing. The controller architecture is coupled to the MRF joystick resistance mechanism and to the joystick position sensor. The controller architecture configured to: (i) detect when an operator moves the joystick in an operator input direction; (ii) when detecting operator movement of the joystick in the operator input direction, determine whether continued joystick movement in the operator input direction will misposition the work vehicle in a manner increasing at least one of work vehicle instability and a likelihood of work vehicle collision; and (iii) when determining that continued joystick movement in the operator input direction will misposition the work vehicle, command the MRF joystick resistance mechanism to generate an MRF resistance force deterring continued joystick movement in the operator input direction.

In further embodiments, the work vehicle MRF joystick system contains a joystick device including a joystick rotatable relative to a base housing, an MRF joystick resistance mechanism controllable to selectively resist rotation of the joystick relative to the base housing about at least one axis, and an obstacle detection system configured to detect obstacles within a proximity of the work vehicle. A controller architecture is coupled to the joystick device, to the MRF joystick resistance mechanism, and to the obstacle detection system. The controller architecture configured to: (i) in response to operator rotation of the joystick in an operator input direction, determine whether continued joystick rotation in the operator input direction will increase a likelihood of work vehicle collision with an obstacle proximate the work vehicle and detected by the obstacle detection system; and (ii) when determining that continued joystick rotation in the operator input direction will increase the likelihood of work vehicle collision, command the MRF joystick resistance mechanism to generate an MRF resistance force deterring continued joystick rotation in the operator input direction.

In still further embodiments, the work vehicle MRF joystick system includes a joystick device having a joystick rotatable relative to a base housing, an MRF joystick resistance mechanism controllable to selectively resist rotation of the joystick relative to the base housing about at least one axis, and a vehicle orientation data source configured to estimate a current orientation of the work vehicle chassis relative to gravity. A controller architecture is coupled to the joystick device, to the MRF joystick resistance mechanism, and to the vehicle orientation data source. The controller architecture configured to: (i) in response to operator rotation of the joystick in an operator input direction, determine whether continued joystick rotation in the operator input direction will increase work vehicle instability based, at least in part, on the current orientation of the work vehicle chassis; and (ii) when determining that continued joystick rotation in the operator input direction will increase the susceptibility of the work vehicle to collision with an obstacle, command the MRF joystick resistance mechanism to generate an MRF resistance force deterring continued joystick rotation in the operator input direction.

The details of one or more embodiments are set-forth in the accompanying drawings and the description below. Other features and advantages will become apparent from the description, the drawings, and the claims.

BRIEF DESCRIPTION OF THE DRAWINGS

At least one example of the present disclosure will hereinafter be described in conjunction with the following figures.

Figure 1:
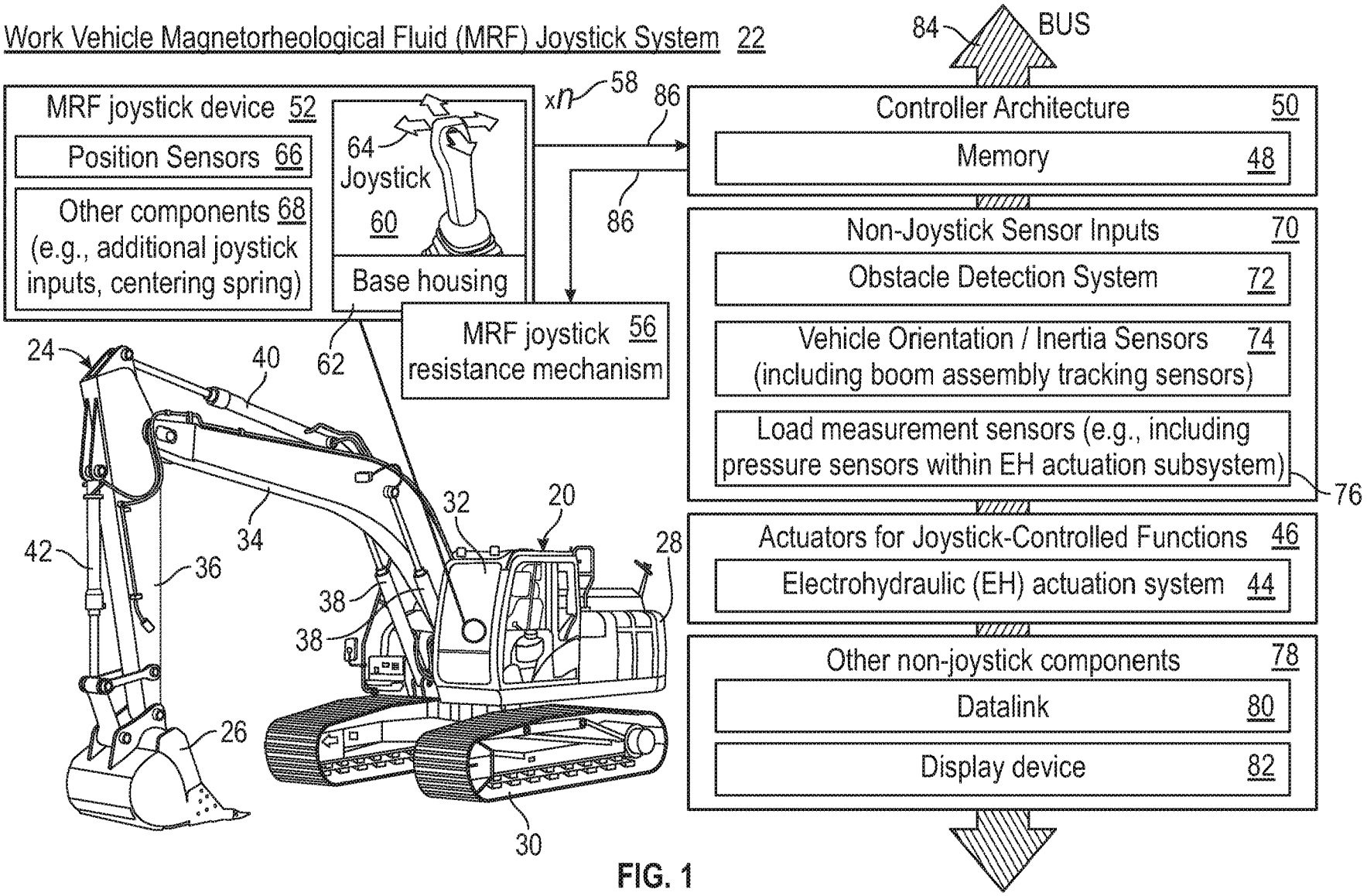
FIG. 1 is a schematic of an example magnetorheological fluid (MRF) joystick system onboard a work vehicle (here, an excavator) and configured to deter joystick motions resulting in potential work vehicle mispositioning, as illustrated in accordance with an example embodiment of the present disclosure.

Like reference symbols in the various drawings indicate like elements. For simplicity and clarity of illustration, descriptions and details of well-known features and techniques may be omitted to avoid unnecessarily obscuring the example and non-limiting embodiments of the invention described in the subsequent Detailed Description. It should further be understood that features or elements appearing in the accompanying figures are not necessarily drawn to scale unless otherwise stated.

DETAILED DESCRIPTION

Embodiments of the present disclosure are shown in the accompanying figures of the drawings described briefly above. Various modifications to the example embodiments may be contemplated by one of skill in the art without departing from the scope of the present invention, as setforth the appended claims. As appearing herein, the term "work vehicle" includes all parts of a work vehicle. Thus, in implementations in which a boom assembly terminating in an implement is attached to the chassis of a work vehicle, the term "work vehicle" encompasses both the chassis and the boom assembly, as well as the implement mounted to the terminal end of the boom assembly.

OVERVIEW

The following discloses work magnetorheological fluid (MRF) joystick systems configured to intelligently restrict joystick motion to deter (that is, discourage or prevent) work vehicle mispositioning. As appearing throughout this document, the term "work vehicle mispositioning" refers to movement of a work vehicle into a position increasing work vehicle instability, into a position increasing the likelihood of work vehicle collision, or both. With respect to work vehicle instability, in particular, a work vehicle may be mispositioned when positioning of the work vehicle renders the work vehicle susceptible to tip-over; e.g., due to the orientation of the vehicle chassis relative to gravity, any load currently carried by the work vehicle (partially if transporting material or a payload), inertial forces acting on the work vehicle, and other such factors. Similarly, in embodiments in which the work vehicle is equipped with a boom assembly, work vehicle instability may be influenced by posturing and movement of the boom assembly. In this latter regard, it may be desirable to selectively restrict joystick motion in a manner reducing vehicle instability due to over-extension or other improper posturing of the boom assembly, particularly when terminating in a load-moving implement (e.g., a bucket or grapple) that may be heavily loaded at various junctures during work vehicle operation. Similarly, when the MRF joystick system seeks to deter joystick motions increasing the likelihood of work vehicle collision, the MRF joystick system may selectively resist joystick motions that would otherwise result in an imminent collision with an obstacle, as well as joystick motions predicted to increase the susceptibility of the work vehicle to such a collision; e.g., as may be the case when a particular joystick movement, if permitted to continue unrestricted, is projected to bring some portion of the work vehicle in an undesirably close proximity with a neighboring obstacle.

Embodiments of the MRF joystick system include an MRF-based resistance mechanism (herein, the "MRF joystick resistance mechanism"), a processing subsystem or "controller architecture," and one or more operator-manipulated joystick devices. During operation of the MRF joystick system, the controller architecture repeatedly assesses or projects whether detected operator-commanded joystick motions will result in work vehicle mispositioning should such joystick motions continue without restriction. In so doing, the controller architecture may monitor for joystick movement (e.g., rotation) relative to a base housing of the joystick device. When joystick movement occurs in a particular direction (herein, the "operator input direction"), the controller architecture determines whether continued joystick movement in the operator input direction will misposition the work vehicle in a manner increasing work vehicle instability or in a manner a likelihood of work vehicle collision. If so determining, the controller architecture controls or commands the MRF joystick resistance mechanism to generate an MRF resistance force deterring continued joystick movement in the operator input direction. This provides an intuitive tactile cue to the work vehicle operator to slow, if not halt movement of the joystick in the operator input direction. Further, in instances in which the controller architecture commands the MRF joystick resistance mechanism to generate a maximum MRF resistance force, the MRF resistance force may be sufficient to fully arrest joystick motion in the operator input direction (or at least render such joystick motion highly difficult). Conversely, if the controller architecture determines that continued joystick movement in the operator input direction will not cause work vehicle mispositioning, the controller architecture allows the joystick movement to continue unhindered. Intelligently applied in this manner, the MRF joystick resistance may be effectively transparent to a work vehicle operator under normal operating conditions when joystick motions do not risk mispositioning the work vehicle.

The particular technique or algorithm employed by the controller architecture to determine whether continued joystick movement in an operator input direction will result in work vehicle mispositioning will differ among embodiments depending various factors. Such factors may include the type of work vehicle into which the MRF joystick system is integrated, the joystick-controlled functions supported by the work vehicle, and the type or types of mispositioning the MRF joystick system is designed to deter. Generally, the controller architecture will typically capture pertinent data on a relatively rapid (real-time) iterative basis; and, in response to detection of joystick movement in a particular operator input direction, utilize the captured data to forecast the future positioning of the work vehicle into a near future timeframe (lookahead window) should the newly-detected joystick motion continue in the operator input direction. The controller architecture may then determine whether work vehicle, moved into such a future position, is likely to become unstable, to collide with a nearby object (including, perhaps, another portion of the work vehicle itself), or to come undesirably close to such a collision.

In embodiments in which the MRF joystick system seeks to deter joystick motions causing work vehicle instability, the controller architecture may evaluate whether the future work vehicle positioning would result in excessive work vehicle instability, such as a high probability of work vehicle tip-over. In rendering this forecast or determination, the controller architecture considers data input from multiple data sources. Such data sources may include various sensors onboard the work vehicle, which provide data indicative of one or more of the following parameters: (i) a current orientation of the work vehicle chassis relative to gravity (e.g., as monitored by one or more inertial measurement units (IMUs) containing microelectromechanical system (MEMS) devices, inclinometers, or similar sensors onboard the work vehicle), (ii) a current motion state of the work vehicle (e.g., as reported by IMUs or other sensors onboard the work vehicle), (iii) any load currently carried by the work vehicle (as may be pertinent when the work vehicle is equipped with a bed, tank, bucket, grapple, or other load-carrying implement), and/or (iv) the current position and movement of any boom assembly attached to the work vehicle; e.g., as measured by boom tracking sensors integrated into the boom assembly. Various data items may also be recalled from memory pertaining to the physical characteristics of the work vehicle (e.g., the track or wheelbase of the work vehicle, the center of gravity (CG) of the work vehicle, a model of any boom assembly attached to the work vehicle, and other such data) to the extent useful in projecting or modeling future work vehicle instability should the detected joystick motion continue in the operator input direction.

In embodiments in which the MRF joystick system functions to deter joystick motions increasing the likelihood of work vehicle collision, the controller architecture again utilizes relevant data inputs to forecast or project a position of the work vehicle in a near future timeframe (e.g., a few seconds or less) should joystick movement continue in the operator input position unhindered. The controller architecture may then compare the projected future position of the work vehicle to the location (and perhaps motion state) of any obstacles in the vicinity of the work vehicle to determine whether there arises an undesirably elevated risk of work vehicle collision. Examples of obstacles commonly located within the operational environments of work vehicles include other work vehicles, manmade structures (e.g., buildings, signage, telephone poles, light posts, parking structures, and so on), personnel, and geographical features including bodies of water, trees, and topological features. Additionally, in embodiments in which one portion of a work vehicle (e.g., an implement) is capable of inadvertently striking another portion of the work vehicle (e.g., the vehicle body or tires), the controller architecture may also such a potential collision in determining whether a particular joystick motion, if permitted to continue unhindered, is likely to result in collision of the work vehicle with itself.

In evaluating the collision risk posed by operator-commanded joystick motions, the controller architecture may determine the location of such obstacles relative to the work vehicle utilizing any number of data sources. A non-exhaustive list of such data sources includes stored map data (if marking the location of obstacles within the work environment), data provided by an obstacle detection system onboard the work vehicle (e.g., a 360 degree radar, lidar, camera, or ultrasonic sensor system), or perhaps work vehicle traffic data reporting the current positions of work vehicles in vicinity of the work vehicle. The controller architecture further gathers data to predict the future position of the work vehicle (including, or perhaps solely focusing on, the future position of any boom assembly if present), with such data potentially including the current motion state of the work vehicle (e.g., as measured by one or more IMUs) and/or the current position of the work vehicle in a mapped environment (e.g., as monitored utilizing a Global Positioning System (GPS) module or other locationing system). Again, physical characteristics of the work vehicle or a work vehicle model (including the dimensions and motion characteristics of any boom assembly) may be recalled from memory and utilized by the controller architecture to determine whether continued motion of the joystick in the operator input direction will result in an increased likelihood of work vehicle collision with a nearby obstacle or, perhaps, a collision between one portion of the work vehicle with another portion of the work vehicle.

Embodiments of the MRF joystick system can provide a range of MRF resistance responses depending upon, for example, the predicted severity or immediacy of a potential work vehicle mispositioning event. For example, in implementations in which the MRF joystick system seeks to deter joystick motions increasing the likelihood of work vehicle collision, the controller architecture may command the MRF joystick resistance mechanism to generate a peak or maximum resistance force in an attempt to significantly impede, if not wholly arrest joystick motion when determining that there exists an imminent risk of work vehicle collision. If instead determining that such a collision risk is elevated, but non-imminent, the controller architecture may command the MRF joystick resistance mechanism to initially apply a low or moderate MRF resistance force determining the problematic joystick motion. The controller architecture may then increase the MRF resistance force, in either a gradual or stepwise fashion, should the operator continue to move the joystick in the operator input direction despite the initial application of the MRF resistance force.

A similar approach may likewise be employed in implementations in which the MRF joystick system seeks to deter joystick motions increasing work vehicle instability. In this latter case, the controller architecture may command the MRF joystick resistance mechanism to generate a maximum resistance force in an attempt to fully arrest joystick motion in the operator input direction should the controller architecture determine that a particular joystick motion, if permitted to continue, will result in critical work vehicle instability, such as a high probability of work vehicle over-turn or tip-over. Comparatively, if determining that a joystick motion will result in an elevated, but less critical state of work vehicle instability, the controller architecture may command the MRF resistance mechanism initially generate a lower MRF resistance force resisting continued joystick motion in the operator input direction. The controller architecture may then command the MRF resistance mechanism to increase the MRF resistance force, in a continual or stepwise manner, if appropriate. Advantageously, such an approach provides operators with highly intuitive tactile cues, as communicated through the MRF joystick device itself, to enhance operator awareness regarding joystick motions potentially causing work vehicle mispositioning. Joystick motions that would otherwise cause an increased susceptibility to work vehicle collision or in an increased likelihood of work vehicle instability may be minimized, if not avoided as a result.

Notably, the usage of MRF technology to selectively resist problematic joystick motions (here, joystick motions predicted to result in work vehicle mispositioning) provides several benefits over the usage of other mechanisms (e.g., brake mechanisms and artificial force feedback (AFF) motors) also capable of selectively restricting joystick motions. As one such benefit, the rheological properties (e.g., viscosity) of a given magnetorheological fluid often can be adjusted in relatively precise, drastic, and rapid manner through variations in the strength of an electromagnetic (EM) field in which the magnetorheological fluid is immersed. As the strength of an EM field can likewise be varied in a controlled and responsive manner, the MRF joystick resistance can provide highly abbreviated, low lag response times on the order of, for example, a few milliseconds (ms) or less. Further, the MRF joystick resistance mechanism may be capable of precisely varying the strength of the MRF resistance force over a continuous range. These characteristics allow the MRF joystick device to generate various different tactile resistance effects perceptible to work vehicle operators. Such resistance effects can include detent effects, progressive increases in joystick resistance or "stiffness" as the joystick is moved in a particular direction, and the generation of virtual hard stops or walls preventing (or at least strongly deterring) continued joystick motion in a given direction. As a still further benefit, the MRF joystick system may provide highly reliable, low noise operation, while incorporating the usage of non-toxic (e.g., carbonyl iron-containing) magnetorheological fluids, as further discussed below.

An example embodiment of a work vehicle MRF joystick system will now be described in conjunction with FIGS. 1-7. In the below-described example, the MRF joystick system is principally discussed in the context of a particular type of work vehicle, namely, an excavator. Additionally, in the following example, the MRF joystick system includes two joystick devices, which each have a joystick rotatable about two perpendicular axes and which are utilized to control movement of the excavator boom assembly and the implement (e.g., bucket) attached thereto. The following example notwithstanding, the MRF joystick system may include a greater or lesser number of joysticks in further implementations, with each joystick device movably in any number of degrees of freedom (DOFs) and along any suitable motion pattern; e.g., in alternative embodiments, a given joystick may be rotatable about a single axis or, perhaps, may be restricted to movement along a predefined track (e.g., H-shaped track) or motion pattern. Further, embodiments of the below-described MRF joystick system can be deployed on wide range of work vehicles having various different joystick-controlled functions, additional examples of which are discussed below in connection with FIG. 8.

Example MRF Joystick System for Reducing Work Vehicle Mispositioning

Referring initially to FIG. 1, an example work vehicle (here, an excavator 20) equipped with a work vehicle MRF joystick system 22 is presented. In addition to the MRF joystick system 22, the excavator 20 includes a boom assembly 24 terminating in a tool or implement, such a bucket 26. Various other implements can be interchanged with the bucket 26 and attached to the terminal end of the boom assembly 24 including, for example, other buckets, grapples, and hammers. The excavator 20 features a body or chassis 28, a tracked undercarriage 30 supporting the chassis 28, and a cabin 32 located at forward portion of the chassis 28 and enclosing an operator station. The excavator boom assembly 24 extends from the chassis 28 and contains, as principal structural components, an inner or proximal boom 34 (hereafter, "the hoist boom 34"), an outer or distal boom 36 (hereafter, "the dipperstick 36"), and a number of hydraulic cylinders 38, 40, 42. The hydraulic cylinders 38, 40, 42 include, in turn, two hoist cylinders 38, a dipperstick cylinder 40, and a bucket cylinder 42. Extension and retraction of the hoist cylinders 38 rotates the hoist boom 34 about a first pivot joint at which the hoist boom 34 is joined to the excavator chassis 28, here at location adjacent (to the right of) the cabin 32. Extension and retraction of the dipperstick cylinder 40 rotates the dipperstick 36 about a second pivot joint at which the dipperstick 36 is joined to the hoist boom 34. Finally, extension and retraction of the bucket cylinder 42 rotates or "curls" the excavator bucket 26 about a third pivot joint at which the bucket 26 is joined to the dipperstick 36.

The hydraulic cylinders 38, 40, 42 are included in an electrohydraulic (EH) actuation system 44, which is encompassed by a box 46 entitled "actuators for joystick-controlled functions" in FIG. 1. Movements of the excavator boom assembly 24 are controlled utilizing at least one joystick located within the excavator cabin 32 and included in the MRF joystick system 22. Specifically, an operator may utilize the joystick or joysticks included in the MRF joystick system 22 to control the extension and retraction of the hydraulic cylinders 38, 40, 42, as well as to control the swing action of the boom assembly 24 via rotation of the excavator chassis 28 relative to the tracked undercarriage 30. The depicted EH actuation system 44 also contains various other non-illustrated hydraulic components, which may include flow lines (e.g., flexible hoses), check or relief valves, pumps, a, fittings, filters, and the like. Additionally, the EH actuation system 44 contains electronic valve actuators and flow control valves, such as spool-type multi-way valves, which can be modulated to regulate the flow of pressurized hydraulic fluid to and from the hydraulic cylinders 38, 40, 42. This stated, the particular construction or architecture of the EH actuation system 44 is largely inconsequential to embodiments of the present disclosure, providing that the below-described controller architecture 50 is capable of controlling movement of the boom assembly 24 via commands transmitted to selected ones of the actuators 46 effectuating the joystick controlled functions of the excavator 20.

As schematically illustrated in an upper left portion of FIG. 1, the work vehicle MRF joystick system 22 contains one or more MRF joystick devices 52, 54. As appearing herein, the term "MRF joystick device" refers to an operator input device including at least one joystick or control lever, the movement of which can be selectively impeded utilizing an MRF joystick resistance mechanism of the type described herein. While one such MRF joystick device 52 is schematically shown in FIG. 1 for clarity, the MRF joystick system 22 can include any practical number of joystick devices, as indicated by symbol 58. In the case of the example excavator 20, the MRF joystick system 22 will typically include two joystick devices; e.g., joystick devices 52, 54 described below in connection with FIG. 2. The manner in which two such joystick devices 52, 54 may be utilized to control movement of the excavator boom assembly 24 is further discussed below. First, however, a general discussion of the joystick device 52, as schematically illustrated in FIG. 1, is provided to establish a general framework in which embodiments of the present disclosure may be better understood.

As schematically illustrated in FIG. 1, the MRF joystick device 52 includes a joystick 60 mounted to a lower support structure or base housing 62. The joystick 60 is movable relative to the base housing 62 in at least one DOF and may be rotatable relative to the base housing 62 about one or more axes. In the depicted embodiment, and as indicated by arrows 64, the joystick 60 of the MRF joystick device 52 is rotatable relative to the base housing 62 about two perpendicular axes and will be described below as such. The MRF joystick device 52 includes one or more joystick position sensors 66 for monitoring the current position and movement of the joystick 60 relative to the base housing 62. Various other components 68 may also be included in the MRF joystick device 52 including buttons, dials, switches, or other manual input features, which may be located on the joystick 60 itself, located on the base housing 62, or a combination thereof. Spring elements (gas or mechanical), magnets, or fluid dampers may be incorporated into the joystick device 52 to provide a desired rate of return to a home position of the joystick, as well as to fine-tune the desired feel or "stiffness" of the joystick 60 perceived by an operator when interacting with the MRF joystick device 52. In more complex components, various other components (e.g., potentially including one or more AFF motors) can also be incorporated into the MRF joystick device 52. In other implementations, such components may be omitted from the MRF joystick device 52.

An MRF joystick resistance mechanism 56 is at least partially integrated into the base housing 62 of the MRF joystick device 52. The MRF joystick resistance mechanism 56 can be controlled to selectively resist (that is, impede or prevent) joystick motion relative to the base housing 62. During operation of the MRF joystick system 22, the controller architecture 50 may selectively command the MRF joystick resistance mechanism 56 to apply a controlled resistance force (herein, a "MRF resistance force") impeding joystick rotation about a particular axis or combination of axes. As discussed more fully below, the controller architecture 50 may command the MRF joystick resistance mechanism 56 to apply such an MRF resistance force by increasing the strength of an EM field in which a magnetorheological fluid contained in the mechanism 56 is at least partially immersed. A generalized example of one manner in which the MRF joystick resistance mechanism 56 may be realized is described below in connection with FIGS. 3 and 4. The controller architecture 50 may command the MRF motion resistance mechanism 56 to generate such an MRF resistance force when determining that continued rotation of the joystick 60 in a particular direction (herein, the "operator input direction") will result in work vehicle mispositioning; that is, positioning the work vehicle in a manner increasing the likelihood of work vehicle collision or work vehicle instability. In the case of the excavator 20, in particular, the controller architecture 50 determines whether continued rotation of the joystick 60 included in the MRF joystick device 52 (and/or continued rotation of another joystick included in a second, similar MRF joystick device) will misposition the excavator boom assembly 24 in a manner increasing: (i) the likelihood of collision between the boom assembly 24 (including the bucket 26) and any nearby obstacles (including other portions of the excavator 20), and/or (ii) increasing excavator instability due to improper posturing of the boom assembly 24, particularly when the bucket 26 is heavily loaded.

In projecting whether rotation of the joystick 60 (and/or a second joystick included in the MRF joystick system 22) will misposition the excavator boom assembly 24, the controller architecture 50 considers input from multiple data sources including a number of non joystick sensors 70 onboard the excavator 20. Such non-joystick sensors 70 may include sensors contained in an obstacle detection system 72, which may be integrated into the excavator 20 in embodiment. In this regard, certain work vehicles (including excavators) now commonly equipped with relatively comprehensive (e.g., 360 degree) obstacle detection systems, which provide highly accurate, broad coverage detection of obstacles in proximity of the work vehicle using, for example, lidar, radar, or ultrasonic sensors arrays. Such an obstacle detection system 72 may also detect obstacles within the vicinity of the excavator 20 through visual analysis or image processing of live camera feeds supplied by one or more cameras positioned about the excavator 20 in embodiments. This obstacle detection data, as collected by the obstacle detection system 72, may then be placed on a vehicle bus, such as a controller area network (CAN) bus 84, or may otherwise be provided to the controller architecture 50 for consideration in embodiments in which the excavator 20 with such an obstacle detection system 72 and the MRF joystick system 22 seeks to deter joystick motions increasing the likelihood of excavator collision.

The non-joystick sensor inputs 70 of the excavator 20 may further include any number and type of sensors for monitoring the position, orientation, and movement of the excavator chassis 28 and/or for monitoring the position and movement of the excavator boom assembly 24. Addressing first the excavator chassis 28, the position and movement of the excavator chassis 28 may be monitored in embodiments in which the MRF joystick system 22 seeks to deter joystick motions increasing the likelihood of excavator collision or instability. Sensor systems suitable for monitoring the position and movement of the excavator chassis 28 include GPS modules, sensors from which the rotational rate of the undercarriage tracks may be calculated, electronic compasses, and MEMS devices, such as accelerometers and gyroscopes, which may be packaged as one or more IMUs. Similarly, the orientation of the excavator chassis 28 relative to gravity (or another reference direction) may be monitored utilizing one or more MEMS devices or tilt sensors (inclinometers) affixed to the chassis 28 in embodiments. The local slope or topology of the terrain beneath the excavator 20 may also be measured or estimated utilizing map data (as described below) or sensors (e.g., laser-based sensors) for measuring local ground slope.

The non-joystick input sensors 74 may further include any number and type of boom assembly tracking sensors suitable tracking the position and movement of the excavator boom assembly 24. Such sensors can include rotary or linear variable displacement transducers integrated into excavator boom assembly 24 in embodiments. For example, in one possible implementation, rotary position sensors may be integrated into the pivot joints of the boom assembly 24; and the angular displacement readings captured by the rotary position sensors, taken in conjunction with known dimensions of the boom assembly 24 (as recalled from the memory 48), may be utilized to track the posture and position of the boom assembly 24 (including the bucket 26) in three dimensional space. In other instances, the extension and reaction of the hydraulic cylinders 38, 40, 42 may be measured (e.g., utilizing linear variable displacement transducers) and utilized to calculate the current posture and positioning of the excavator boom assembly 24. Other sensor inputs can also be considered by the controller architecture 50 in addition or lieu of the aforementioned sensor readings, such as inertia-based sensor readings (as captured by IMUs incorporated into the boom assembly 24) and/or vision system tracking of the excavation implement, to list but a few examples.

One or more load measurement sensors 76, such as weight- or strain-based sensors, may further be included in the non-joystick sensor inputs 70 in at least some implementations of the work vehicle MRF joystick system 22. In embodiments, such load measurement sensors 76 may be utilized to directly measure the load carried by the bucket 26 (generally, a "load-moving implement") at any given time during excavator operation. The load measurement sensors 76 can also measure other parameters (e.g., one or more hydraulic pressures within the EH actuation system 44) indicative of the load carried by the boom assembly 24 in embodiments. In other realizations, the MRF joystick system 22 may be integrated into a work vehicle having a bed or tank for transporting a material, such as the bed of an articulated dump truck. In this latter case, the load measurement sensors 76 may assume the form of payload weighing sensors capable of weighing or approximating the weight of material carried within the bed or tank of the work vehicle at any particular juncture in time.

Embodiments of the MRF joystick system 22 may further include any number of additional non-joystick components 78, such as a wireless datalink 80, a display device 82 located in the excavator cabin 32, and various other non-illustrated componentry of the type commonly included in work vehicles. The datalink 80, when present, may assume the form of a wireless (e.g., radio frequency) transceiver utilized to receive wireless data pertaining to the location and movement of obstacles in a work environment within which the excavator 20 operates. To this end, one or more work vehicles operating in a common work area with the excavator 20 may repeatedly transmit traffic report signals containing location and/or movement (vector) data pertaining to the neighboring work vehicles, which may be received by the datalink 80 and forwarded to the controller architecture 50 as work vehicle traffic data. The controller architecture 50 may then utilize such work vehicle traffic data in tracking the neighboring work vehicles (again, encompassed by the term "obstacles") and in assessing whether a given joystick movement, if permitted to continue unabated, will result in a potential collision (or near collision) between the boom assembly 24 and a neighboring vehicle. Finally, the display device 82 may be located within the cabin 32 and may assume the form of any image-generating device on which visual alerts and other information may be visually presented. The display device 82 may also generate a graphical user interface (GUI) for receiving operator input or may include other inputs (e.g., buttons or switches) for receiving operator input, which may be pertinent to the controller architecture 50 when performing the below-described processes.

As further schematically depicted in FIG. 1, the controller architecture 50 is associated with a memory 48 and may communicate with the various illustrated components over any number of wired data connections, wireless data connections, or any combination thereof; e.g., as generically illustrated, the controller architecture 50 may receive data from various components over a centralized vehicle or CAN bus 84. The term "controller architecture," as appearing herein, is utilized in a non-limiting sense to generally refer to the processing subsystem of a work vehicle MRF joystick system, such as the example MRF joystick system 22. Accordingly, the controller architecture 50 can encompass or may be associated with any practical number of processors, individual controllers, computer-readable memories, power supplies, storage devices, interface cards, and other standardized components. In many instances, the controller architecture 50 may include a local controller directly associated with the joystick interface and other controllers located within the operator station enclosed by the cabin 32, with the local controller communicating with other controllers onboard the excavator 20 as needed. The controller architecture 50 may also include or cooperate with any number of firmware and software programs or computer-readable instructions designed to carry-out the various process tasks, calculations, and control functions described herein. Such computer-readable instructions may be stored within a non-volatile sector of the memory 48 associated with (accessible to) the controller architecture 50. While generically illustrated in FIG. 1 as a single block, the memory 48 can encompass any number and type of storage media suitable for storing computer-readable code or instructions, as well as other data utilized to support the operation of the MRF joystick system 22. The memory 48 may be integrated into the controller architecture 50 in embodiments as, for example, a system-in-package, a system-on-a-chip, or another type of microelectronic package or module.

Figure 2:
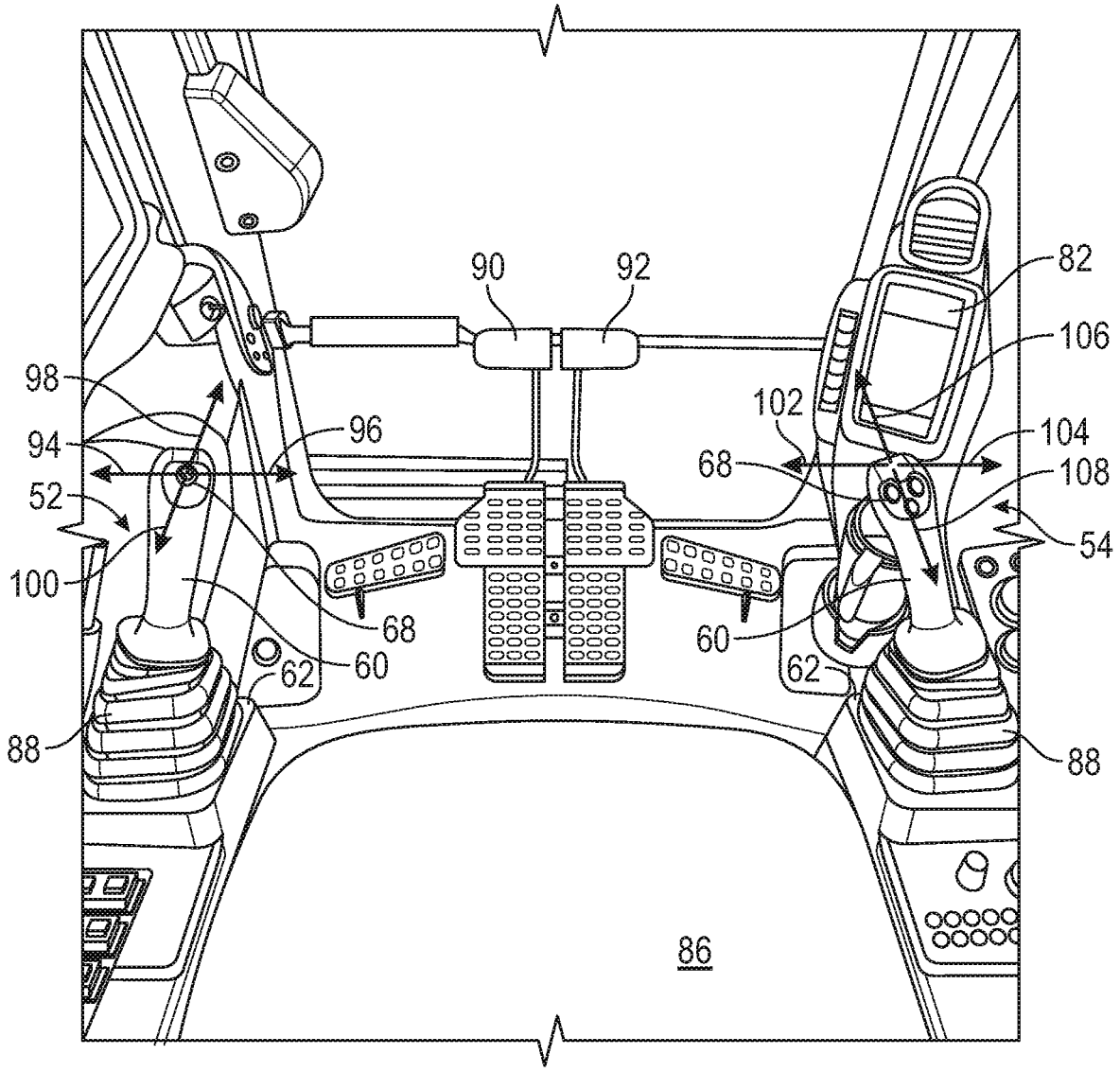
FIG. 2 is a perspective view from within the excavator cabin shown in FIG. illustrating two joystick devices, which may be included in the example MRF joystick system and utilized by an operator to control movement of the excavator boom assembly.

Discussing the joystick configuration or layout of the excavator 20 in greater detail, the number of joystick devices included in the MRF joystick system 22, and the structural aspects and function of such joysticks, will vary amongst embodiments. As previously mentioned, although only a single joystick device 52 is schematically shown in FIG. 1, the MRF joystick system 22 will typically two joystick devices 52, 54 supporting excavator boom assembly control. Further illustrating this point, FIG. 2 provides a perspective view from within the excavator cabin 32 and depicting two MRF joystick devices 52, 54 suitably included in embodiments of the MRF joystick system 22. As can be seen, the MRF joystick devices 52, 54 are positioned on opposing sides of an operator seat 86 such that an operator, using both hands, can concurrently manipulate both the left MRF joystick device 52 and the right joystick device 54 with relative ease. Carrying forward the reference numerals introduced above in connection with FIG. 1, each joystick device 52, 54 includes a joystick 60 mounted to a lower support structure or base housing 62 for rotation relative to the base housing 62 about two perpendicular axes. The joystick devices 52, 54 also each include a flexible cover or boot 88 joined between a lower portion of the joysticks 60 and their respective base housings 62. Additional joystick inputs are also provided on each joystick 60 in the form of thumb-accessible buttons and, perhaps, as other non-illustrated manual inputs (e.g., buttons, dials, and or switches) provided on the base housings 62. Other notable features of the excavator 20 shown in FIG. 2 include the previously-mentioned display device 82 and pedal/control lever mechanisms 90, 92 for controlling the respective movement of the right and left tracks of the tracked undercarriage 30.

Different control schemes can be utilized to translate movement of the joysticks 60 included in the joystick devices 52, 54 to corresponding movement of the excavator boom assembly 24. In many instances, the excavator 20 will support boom assembly control in either (and often allow switching between) a "backhoe control" or "SAE control" pattern and an "International Standard Organization" or "ISO" control pattern. In the case of the backhoe control pattern, movement of the left joystick 60 to the operator's left (arrow 94) swings the excavator boom assembly 24 in a leftward direction (corresponding to counter-clockwise rotation of the chassis 28 relative to the tracked undercarriage 30), movement of the left joystick 60 to the operator's right (arrow 96) swings the boom assembly 24 in a rightward direction (corresponding to clockwise rotation of the chassis 28 relative to the tracked undercarriage 30), movement of the left joystick 60 in a forward direction (arrow 98) lowers the hoist boom 34, and movement of the left joystick 60 in an aft or rearward direction (arrow 100) raises the hoist boom 34. Also, in the case of the backhoe control pattern, movement of the right joystick 60 to the left (arrow 102) curls the bucket 26 inwardly, movement of the right joystick 60 to the right (arrow 104) uncurls or "opens" the bucket 26, movement of the right joystick 60 in a forward direction (arrow 106) rotates the dipperstick 36 outwardly, and movement of the right joystick 60 in an aft direction (arrow 108) rotates the dipperstick 36 inwardly. Comparatively, in the case of an ISO control pattern, the joystick motions for the swing commands and the bucket curl commands are unchanged, while the joystick mappings of the hoist boom and dipperstick are reversed. Thus, in the ISO control pattern, forward and aft movement of the left joystick 60 controls the dipperstick rotation in the previously described manner, while forward and aft movement of the right joystick 60 controls motion (raising and lowering) of the hoist boom 34 in the manner described above.

Figure 3:
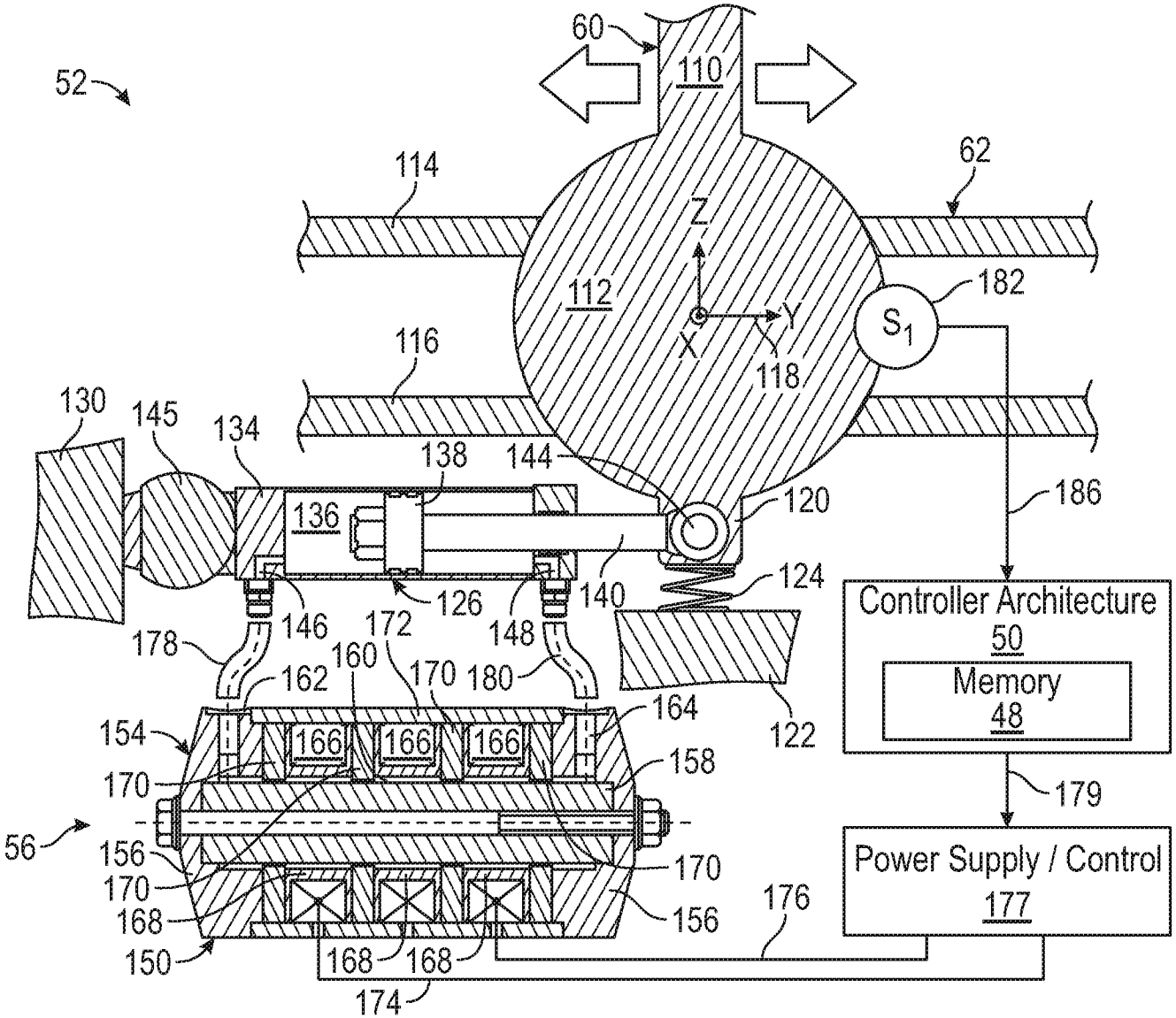
FIGS. 3 and 4 are cross-sectional schematics of the example MRF joystick system, as partially shown and taken along perpendicular section planes through a joystick, illustrating one possible construction of the MRF joystick system.
Figure 4:
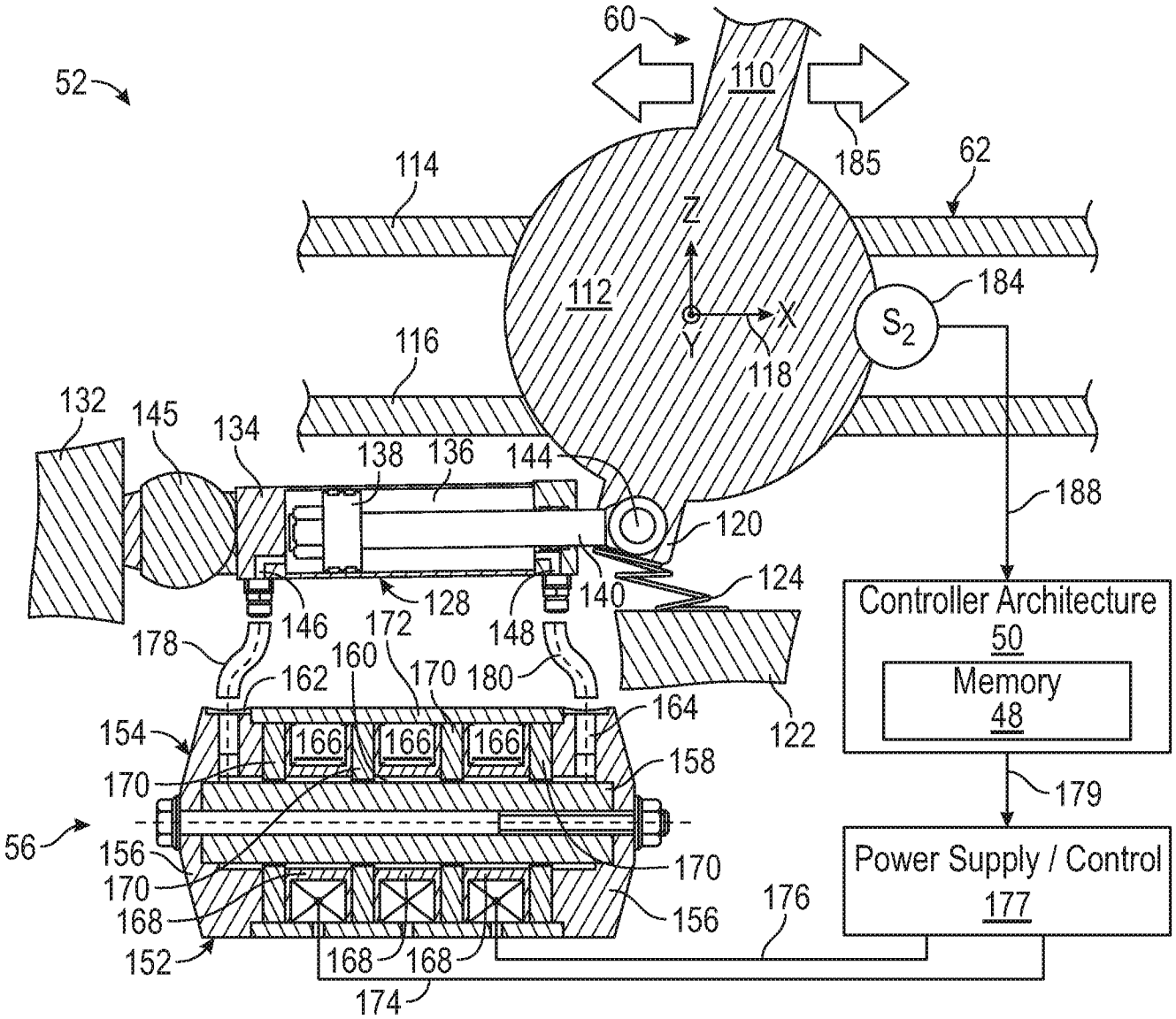

Turning now to FIGS. 3 and 4, an example construction of the MRF joystick device 52 and the MRF joystick resistance mechanism 56 is represented by two simplified cross-sectional schematics. While these drawing figures illustrate a single MRF joystick device (i.e., the MRF joystick device 52), the following description is equally applicable to the other MRF joystick device 54 included in the example MRF joystick system 22. The following description is provided by way of non-limiting example only, noting that numerous different joystick designs incorporating or functionally cooperating with MRF joystick resistance mechanisms are possible. So too is the particular composition of the magnetorheological fluid largely inconsequential to embodiments of the present disclosure, providing that meaningful variations in the rheological properties (viscosity) of the magnetorheological fluid occur in conjunction with controlled variations in EM field strength, as described below. For completeness, however, is noted that one magnetorheological fluid composition well-suited for usage in embodiments of the present disclosure contains magnetically-permeable (e.g., carbonyl iron) particles dispersed in a carrier fluid, which is predominately composed of an oil or an alcohol (e.g., glycol) by weight. Such magnetically-permeable particles may have an average diameter (or other maximum cross-sectional dimension if the particles possess a non-spherical (e.g., oblong) shape) in the micron range; e.g., in one embodiment, spherical magnetically-permeable particles are used having an average diameter between one and ten microns. Various other additives, such as dispersants or thinners, may also be included in the magnetorheological fluid to fine-tune the properties thereof.

Referring now to the example joystick construction shown in FIGS. 3 and 4, and again carrying forward the previously-introduced reference numerals as appropriate, the MRF joystick device 52 includes a joystick 60 having at least two distinct portions or structural regions: an upper handle 110 (only a simplified, lower portion of which is shown in the drawing figures) and a lower, generally spherical base portion 112 (hereafter, the "generally spherical base 112"). The generally spherical base 112 of the joystick 60 is captured between two walls 114, 116 of the base housing 62, which may extend substantially parallel to one another to form an upper portion of the base housing 62. Vertically-aligned central openings are provided through the housing walls 114, 116, with the respective diameters of the central openings dimensioned to be less than the diameter of the generally spherical base 112. The spacing or vertical offset between the walls 114, 116 is further selected such that the bulk of generally spherical base 112 is captured between the vertically-spaced housing walls 114, 116 to form a ball-and-socket type joint. This permits rotation of the joystick 60 relative to the base housing 62 about two perpendicular axes, which correspond to the X- and Y-axes of a coordinate legend 118 appearing in FIGS. 3 and 4; while generally preventing translational movement of the joystick 60 along the X-, Y-, and Z-axes of the coordinate legend 118. In further embodiments, various other mechanical arrangements can be employed to mount a joystick to a base housing, while allowing rotation of the joystick about two perpendicular axis, such as a gimbal arrangement. In less complex embodiments, a pivot or pin joint may be provided to permit rotation of the joystick 60 relative to the base housing 62 about a single axis.

The joystick 60 of MRF joystick device 52 further includes a stinger or lower joystick extension 120, which projects from the generally spherical base 112 in a direction opposite the joystick handle 110. The lower joystick extension 120 is coupled to a static attachment point of the base housing 62 by a single return spring 124 in the illustrated schematic; here noting that such an arrangement is simplified for the purposes of illustration and more complex spring return arrangements (or other joystick biasing mechanisms, if present) will typically be employed in actual embodiments of the MRF joystick device 52. When the joystick 60 is displaced from the neutral or home position shown in FIG. 3, the return spring 124 deflects as shown in FIG. 4 to urge return of the joystick 60 to the home position (FIG. 3). Consequently, as an example, after rotation into the position shown in FIG. 4, the joystick 60 will return to the neutral or home position shown in FIG. 3 under the influence of the return spring 124 should the work vehicle operator subsequently release the joystick handle 110.

The example MRF joystick resistance mechanism 56 includes a first and second MRF cylinders 126, 128 shown in FIGS. 3 and 4, respectively. The first MRF cylinder 126 (FIG. 3) is mechanically joined between the lower joystick extension 120 and a partially-shown, static attachment point or infrastructure feature 130 of the base housing 62. Similarly, the second MRF cylinder 128 (FIG. 4) is mechanically joined between the lower joystick extension 120 and a static attachment point 132 of the base housing 62, with the MRF cylinder 128 rotated relative to the MRF cylinder 126 by approximately 90 degrees about the Z-axis of the coordinate legend 118. Due to this structural configuration, the MRF cylinder 126 (FIG. 3) is controllable to selectively resist rotation of the joystick 60 about the X-axis of coordinate legend 118, while the MRF cylinder 128 (FIG. 4) is controllable to selectively resist rotation of the joystick 60 about the Y-axis of coordinate legend 118. Additionally, both MRF cylinders 126, 128 can be jointly controlled to selectively resist rotation of the joystick 60 about any axis falling between the X- and Y-axes and extending within the X-Y plane. In other embodiments, a different MRF cylinder configuration may be utilized and include a greater or lesser number of MRF cylinders; e.g., in implementations in which it is desirable to selectively resist rotation of joystick 60 about only the X-axis or only the Y-axis, or in implementations in which joystick 60 is only rotatable about a single axis, a single MRF cylinder or a pair of antagonistic cylinders may be employed. Finally, although not shown in the simplified schematics, any number of additional components can be included in or associated with the MRF cylinders 126, 128 in further implementations. Such additional components may include sensors for monitoring the stroke of the cylinders 126, 128 if desirably known to, for example, track joystick position in lieu of the below-described joystick sensors 182, 184.

The MRF cylinders 126, 128 each include a cylinder body 134 to which a piston 138, 140 is slidably mounted. Each cylinder body 134 contains a cylindrical cavity or bore 136 in which a head 138 of one of the pistons 138, 140 is mounted for translational movement along the longitudinal axis or centerline of the cylinder body 134. About its outer periphery, each piston head 138 is fitted with one or more dynamic seals (e.g., O-rings) to sealingly engaging the interior surfaces of the cylinder body 134, thereby separating the bore 136 into two antagonistic variable-volume hydraulic chambers. The pistons 138, 140 also each include an elongated piston rod 140, which projects from the piston head 138 toward the lower joystick extension 120 of the joystick 60. The piston rod 140 extends through an end cap 142 affixed over the open end of the cylinder body 134 (again, engaging any number of seals) for attachment to the lower joystick extension 120 at a joystick attachment point 144. In the illustrated example, the joystick attachment points 144 assume the form of pin or pivot joints; however, in other embodiments, more complex joints (e.g., spherical joints) may be employed to form this mechanical coupling. Opposite the joystick attachment points 144, the opposing end of the MRF cylinders 126, 128 are mounted to the respective static attachment points 130, 132 via spherical joints 145. Finally, hydraulic ports 146, 148 are further provided in opposing end portions of each MRF cylinder 126, 128 to allow the inflow and outflow of magnetorheological fluid in conjunction with translational movement or stroking of the pistons 138, 140 along the respective longitudinal axes of the MRF cylinders 126, 128.

The MRF cylinders 126, 128 are fluidly interconnected with corresponding MRF values 150, 152, respectively, via flow line connections 178, 180. As is the case with the MRF cylinders 126, 128, the MRF valves 150, 152 are presented as identical in the illustrated example, but may vary in further implementations. Although referred to as "valves" by common terminology (considering, in particular, that the MRF valves 150, 152 function to control magnetorheological fluid flow), it will be observed that the MRF valves 150, 152 lack valve elements and other moving mechanical parts in the instant example. As a beneficial corollary, the MRF valves 150, 152 provide fail safe operation in that, in the unlikely event of MRF valve failure, magnetorheological fluid flow is still permitted through the MRF valves 150, 152 with relatively little resistance. Consequently, should either or both of the MRF valves 150, 152 fail for any reason, the ability of MRF joystick resistance mechanism 56 to apply resistance forces restricting or inhibiting joystick motion may be compromised; however, the joystick 60 will remain freely rotatable about the X- and Y-axes in a manner similar to a traditional, non-MRF joystick system, and the MRF joystick device 52 will remain capable of controlling the excavator boom assembly 24 as typical.

In the depicted embodiment, the MRF valves 150, 152 each include a valve housing 154, which contains end caps 156 affixed over opposing ends of an elongated cylinder core 158. A generally annular or tubular flow passage 160 extends around the cylinder core 158 and between two fluid ports 162, 164, which are provided through the opposing end caps 156. The annular flow passage 160 is surrounded by (extends through) a number of EM inductor coils 166 (hereafter, "EM coils 166"), which are wound around paramagnetic holders 168 and interspersed with a number of axially- or longitudinally-spaced ferrite rings 170. A tubular shroud 172 surrounds this assembly, while a number of leads are provided through the shroud 172 to facilitate electrical interconnection with the housed EM coils 166. Two such leads, and the corresponding electrical connections to a power supply and control source 177, are schematically represented in FIGS. 3 and 4 by lines 174, 176. As indicated by arrows 179, the controller architecture 50 is operably coupled to the power supply and control source 177 in a manner enabling the controller architecture 50 to control the source 177 to vary the current supplied to or the voltage applied across the EM coils 166 during operation of the MRF joystick system 22. This structural arrangement thus allows the controller architecture 50 to command or control the MRF joystick resistance mechanism 56 to vary the strength of an EM field generated by the EM coils 166. The annular flow passage 160 extends through the EM coils 166 (and may be substantially co-axial therewith) such that the magnetorheological fluid passes through the center the EM field when as the magnetorheological fluid is conducted through the MRF valves 150, 152.

The fluid ports 162, 164 of the MRF valves 150, 152 are fluidly connected to the ports 146, 148 of the corresponding the MRF cylinders 126, 128 by the above-mentioned conduits 178, 180, respectively. The conduits 178, 180 may be, for example, lengths of flexible tubing having sufficient slack to accommodate any movement of the MRF cylinders 126, 128 occurring in conjunction with rotation of the joystick 60. Consider, in this regard, the example scenario of FIG. 4. In this example, an operator has moved the joystick handle 110 in an operator input direction (indicated by arrow 185) such that the joystick 60 rotates about the Y-axis of coordinate legend 118 in a clockwise direction. In combination with this joystick motion, the MRF cylinder 128 rotates about the spherical joint 145 to tilt slightly upward as shown. Also, along with this operator-controlled joystick motion, the piston 138, 140 contained in the MRF cylinder 128 retracts such that the piston head 138 moves to the left in FIG. 4 (toward the attachment point 132). The translation movement of the piston 138, 140 forces magnetorheological fluid flow through the MRF valve 152 to accommodate the volumetric decrease of the chamber on the left of the piston head 138 and the corresponding volumetric increase of the chamber to the right of the piston head 138. Consequently, at any point during such an operator-controlled joystick rotation, the controller architecture 50 can vary the current supplied to or the voltage across the EM coils 166 to vary the force resisting magnetorheological fluid flow through the MRF valve 152 and thereby achieve a desired MRF resistance force resisting further stroking of the piston 138, 140.

Given the responsiveness of MRF joystick resistance mechanism 56, the controller architecture 50 can control the resistance mechanism 56 to only briefly apply such an MRF resistance force, to increase the strength of the MRF resistance force in a predefined manner (e.g., in a gradual or stepped manner) with increasing piston displacement, or to provide various other resistance effects (e.g., a tactile detent or pulsating effect), as discussed in detail below. The controller architecture 50 can likewise control the MRF joystick resistance mechanism 56 to selectively provided such resistance effects as the piston 138, 140 included in the MRF valve 150 strokes in conjunction with rotation of the joystick 60 about the X-axis of coordinate legend 118. Moreover, the MRF joystick resistance mechanisms 56 may be capable of independently varying the EM field strength generated by the EM coils 166 within the MRF valves 150, 152 to allow independent control of the MRF resistance forces inhibiting joystick rotation about the X- and Y-axes of coordinate legend 118.

The MRF joystick device 52 may further contain one or more joystick position sensors 182, 184 (e.g., optical or non-optical sensors or transformers) for monitoring the position or movement of the joystick 60 relative to the base housing 62. In the illustrated example, specifically, the MRF joystick device 52 includes a first joystick position sensor 182 (FIG. 3) for monitoring rotation of the joystick 60 about the X-axis of coordinate legend 118, and a second joystick position sensor 184 (FIG. 4) for monitoring rotation of the joystick 60 about the Y-axis of coordinate legend 118. The data connections between the joystick position sensors 182, 184 and the controller architecture 50 are represented by lines 186, 188, respectively. In further implementations, the MRF joystick device 52 can include various other non-illustrated components, as can the MRF joystick resistance mechanism 56. Such components can include operator inputs and corresponding electrical connections provided on the joystick 60 or the base housing 62, AFF motors, and pressure and/or flow rate sensors included in the flow circuit of the MRF joystick resistance mechanism 56, as appropriate, to best suit a particular application or usage.

As previously emphasized, the above-described embodiment of the MRF joystick device 52 is provided by way of non-limiting example only. In alternative implementations, the construction of the joystick 60 can differ in various respects. So too may the MRF joystick resistance mechanism 56 differ in further embodiments relative to the example shown in FIGS. 3 and 4, providing that the MRF joystick resistance mechanism 56 is controllable by the controller architecture 50 to selectively apply a resistance force (through changes in the rheology of a magnetorheological fluid) inhibiting movement of a joystick relative to a base housing in at least one DOF. In further realizations, EM inductor coils similar or identical to the EM coils 166 may be directly integrated into the MRF cylinders 126, 128 to provide the desired controllable MRF resistance effect. In such realizations, magnetorheological fluid flow between the variable volume chambers within a given MRF cylinder 126, 128 may be permitted via the provision of one or more orifices through the piston head 138, by providing an annulus or slight annular gap around the piston head 138 and the interior surfaces of the cylinder body 134, or by providing flow passages through the cylinder body 134 or sleeve itself. Advantageously, such a configuration may impart the MRF joystick resistance mechanism with a relatively compact, integrated design. Comparatively, the usage of one or more external MRF valves, such as the MRF valves 150, 152 (FIGS. 3 and 4), may facilitate cost-effective manufacture and allow the usage of commercially-available modular components in at least some instances.

In still other implementations, the design of the MRF joystick device may permit the magnetorheological fluid to envelop and act directly upon a lower portion of the joystick 60 itself, such as the spherical base 112 in the case of the joystick 60, with EM coils positioned around the lower portion of the joystick and surrounding the magnetological fluid body. In such embodiments, the spherical base 112 may be provided with ribs, grooves, or similar topological features to promote displacement of the magnetorheological fluid in conjunction with joystick rotation, with energization of the EM coils increasing the viscosity of the magnetorheological fluid to impede fluid flow through restricted flow passages provided about the spherical base 112 or, perhaps, due to sheering of the magnetorheological fluid in conjunction with joystick rotation. Various other designs are also possible in further embodiments of the MRF joystick system 22.

Regardless of the particular design of the MRF joystick resistance mechanism 56, the usage of MRF technology to selectively generate a variable MRF resistance force inhibiting (resisting or preventing) problematic joystick motions provides several advantages. As a primary advantage, the MRF joystick resistance mechanism 56 (and MRF joystick resistance mechanisms generally) are highly responsive and can effectuate desired changes in EM field strength, in the rheology of the magnetorheological fluid, and ultimately in the MRF resistance force inhibiting joystick motions in highly abbreviated time periods; e.g., time periods on the order of 1 ms in certain instances. Correspondingly, the MRF joystick resistance mechanism 56 may enable the MRF resistance force to be removed (or at least greatly reduced) with an equal rapidity by quickly reducing current flow through the EM coils and allowing the rheology of the magnetorheological fluid (e.g., fluid viscosity) to revert to its normal, unstimulated state. The controller architecture 50 can further control the MRF joystick resistance mechanism 56 to generate the MRF resistance force to have a continuous range of strengths or intensities, within limits, through corresponding changes in the strength of the EM field generated utilizing the EM coils 166. Beneficially, the MRF joystick resistance mechanism 56 can provide reliable, essentially noiseless operation over extended time periods. Additionally, the magnetorheological fluid can be formulated to be non-toxic in nature, such as when the magnetorheological fluid contains carbonyl iron-based particles dispersed in an alcohol-based or oil-based carrier fluid, as previously described. Finally, as a still further advantage, the above-described configuration of the MRF joystick resistance mechanism 56 allows the MRF joystick system 22 to selectively generate a first resistance force deterring joystick rotation about a first axis (e.g., the X-axis of coordinate legend 118 in FIGS. 3 and 4), while further selectively generating a second resistance force deterring joystick rotation about a second axis (e.g., the Y-axis of coordinate legend 118) independently of the first resistance force; that is, such that the first and second resistance forces have different magnitudes, if desired.

Figure 5:
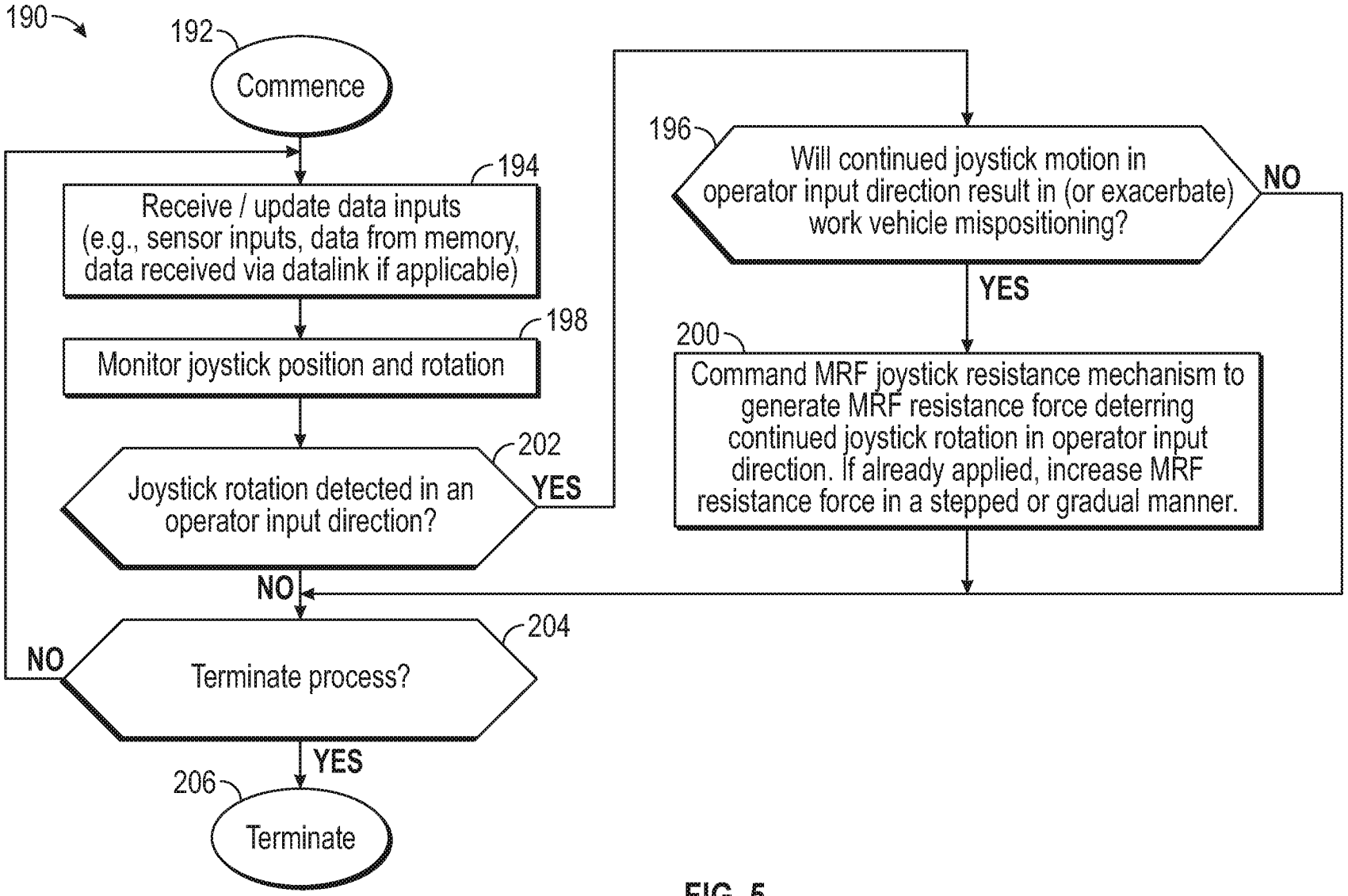
FIG. 5 is a flowchart of a master process carried-out by a controller architecture of the MRF joystick system to reduce the likelihood of work vehicle mispositioning during operation of the excavator shown in FIG. 1 in an example embodiment.

Advancing next to a discussion of FIG. 5, there is presented an example master process 190 suitably carried-out by the controller architecture 50 to reduce the likelihood of excavator (or other work vehicle) mispositioning is presented. The master process 190 (hereafter, the "selective MRF joystick motion restriction process 190") includes a number of process STEPS 192, 194, 196, 198, 200, 202, 204, 206, each of which is described, in turn, below. Depending upon the particular manner in which the selective MRF joystick motion restriction process 190 is implemented, each step generically illustrated in FIG. 5 may entail a single process or multiple sub-processes. Further, the steps illustrated in FIG. 5 and described below are provided by way of non-limiting example only. In alternative embodiments of the selective MRF joystick motion restriction process 190, additional process steps may be performed, certain steps may be omitted, and/or the illustrated process steps may be performed in alternative sequences.

The selective MRF joystick motion restriction process 190 commences at STEP 192 in response to the occurrence of a predetermined trigger event. The trigger event can be startup of a work vehicle (e.g., the excavator 20 shown in FIGS. 1 and 2) or, instead, entry of operator input specifically activating the intelligent MRF joystick motion resistance function; e.g., in one embodiment, an operator may interact with a GUI generated on the display device 82 to active this function as a user-selectable option. In other instances, the master process 190 may commence when the controller architecture 50 detects the activation or usage of a joystick-controlled work vehicle function susceptible to work vehicle mispositioning. For example, in the case of the example excavator 20 (FIG. 1), the trigger event initiating the master process 190 may be usage of the MRF joystick devices 52, 54 (FIGS. 1-4) to control movement of the excavator boom assembly 24; e.g., the master process 190 may commence after a defined time period (e.g., a few seconds) of continuous boom assembly movement. In still other instances, the controller architecture 50 may monitor for a different trigger event initiating the master process 190, such as attachment of a particular type of tool or work implement to the work vehicle; e.g., in the case of the excavator 20, the master process 190 may initiate when a load-moving implement, such as a bucket or a grapple, is attached to the terminal end of the boom assembly 24. A non-exhaustive list of still further trigger events potentially utilized to initiate the master process 190 in embodiments includes travel of the work vehicle at speeds surpassing a speed threshold, operation of the work vehicle in an obstacle-dense work environment, or operation of the work vehicle on non-level terrain.

After commencing the selective MRF joystick motion restriction process 190, the controller architecture 50 progresses to STEP 194 and collects input data from one or more data sources onboard the work vehicle. In effect, during STEP 194, the controller architecture 50 gathers the information utilized in performing the remainder of the master process 190. The particular data parameters collected by the controller architecture 50 during STEP 194 will vary among embodiments depending, in part, on the type of work vehicle under consideration, the joystick-controlled function or functions under consideration, and the type of work vehicle mispositioning at issue. Examples of data parameters suitably collected during STEP 194 of the master process 190 in instances in which the MRF joystick system 22 discourages or prevents joystick motions increasing the likelihood of work vehicle collision are set-forth below in connection with FIG. 6. Similarly, examples of the data parameters collected during STEP 194 in embodiments in which the MRF joystick system 22 discourages or prevents joystick motions increasing work vehicle instability are described below in connection with FIG. 7.

Progressing to STEP 198 of the selective MRF joystick motion restriction process 190, the controller architecture 50 next receives data indicative of the current joystick movement and position of the MRF joystick device or devices under consideration. In the case of the example excavator 20, the controller architecture 50 receives data from the joystick position sensors 182, 184 contained in the MRF joystick devices 52, 54 during STEP 198 regarding the movement of the respective joysticks 60 included in the devices 52, 54. The controller architecture 50 then utilizes this data to determine whether operationally-significant movement of one or more joystick has occurred, discounting joystick jitter or other unintended joystick motions potentially occurring in high vibratory environments. If such joystick motion is detected, the controller architecture 50 progresses to STEP 196 of the selective MRF joystick motion restriction process 190, as described below. Otherwise, the controller architecture 50 advances to STEP 204 and determines whether the current iteration of the selective MRF joystick motion restriction process 190 should terminate; e.g., due to work vehicle shutdown, due to continued inactivity of the joystick-controlled function for a predetermined time period, or due to removal of the condition or trigger event in response to which the master process 190 was initially commenced. If determining that the selective MRF joystick motion restriction process 190 should terminate at STEP 206, the controller architecture 50 progresses to STEP 206 of the master process 190, the master process 190 terminates accordingly. If instead determining that the selective MRF joystick motion restriction process 190 should continue, the controller architecture 50 returns to STEP 194 and the above-described process steps repeat.

In response to detecting joystick rotation (or other movement) at STEP 202, the controller architecture 50 advances to STEP 196 of the master process 190 and projects whether continued motion of the joystick in the detected direction (the operator input direction) will result in or exacerbate work vehicle mispositioning. The controller architecture 50 renders this prediction based on the previously-detected joystick movements, as detected during STEP 198; the data inputs received during STEP 194; and any other pertinent information. Various different modeling approaches or forecasting techniques can be utilized to project a future or "lookahead" position and orientation of the work vehicle; and, therefore, determine whether the work vehicle is projected to strike a nearby obstacle (including collision between different portions of a work vehicle), to come undesirable close to collision with a nearby obstacle, or to experience some degree of instability during STEP 196 of the master process 190. Examples of such approaches are further discussed below in connection with FIG. 6 (pertaining to mispositioning increasing the likelihood of work vehicle collision) and FIG. 7 (pertaining to mispositioning increasing the work vehicle instability). It is emphasized, however, that the following examples are provided by way of example only and that any suitable technique, currently known or later developed, for predicting the likelihood of work vehicle collision or the severity of work vehicle instability in view of anticipated joystick motions can be utilized in embodiments of the present disclosure.

If determining that continued joystick rotation (or other motion) in the operator input direction will result in work vehicle mispositioning during STEP 196 of the master process 190, the controller architecture 50 commands the MRF resistance mechanism 56 to generate an MRF resistance force inhibiting such continued joystick rotation. A range of motion resistance effects can be applied by the controller architecture 50 at STEP 200 of the selective MRF joystick motion restriction process 190. If an MRF resistance force has not yet been applied, the controller architecture 50 may initially command the MRF resistance mechanism 56 to generate a low or moderate level MRF resistance effect. If, instead, an MRF resistance force was previously generated and, despite this, joystick rotation has continued in the operator input direction, the controller architecture 50 may command the MRF joystick resistance mechanism 56 to increase the MRF resistance force in a gradual (stepped or continuous) manner. Various other tactile effects can be also be applied during STEP 200 of the master process 190, as desired, including detent effects or pulsating effects providing a work vehicle operator with an intuitive tactile or haptic notification alerting the operator to the forecast potential of work vehicle mispositioning. Additional discussion of such MRF resistance effects suitably generated during STEP 200 of the master process 190 is provided below in connection with FIGS. 5 and 6.

After applying the desired MRF resistance effect (STEP 200), the controller architecture 50 advances to STEP 204 and determines whether the selective MRF joystick motion restriction process 190 should continue or terminate, as previously described. If instead determining that continued joystick rotation in the detected operator input direction will not result in work vehicle mispositioning during STEP 196, the controller architecture 50 progresses directly to STEP 204, while bypassing STEP 200 of the master process 190. In this manner, the controller architecture 50 allows unimpeded joystick movement in a typical manner such that work vehicle mispositioning avoidance functionality of the MRF joystick system 22 may be noticeable to vehicle operators exclusively when needed to avoid problematic joystick motions likely to increase work vehicle instability, the likelihood of work vehicle collision, or both.

Figure 6:
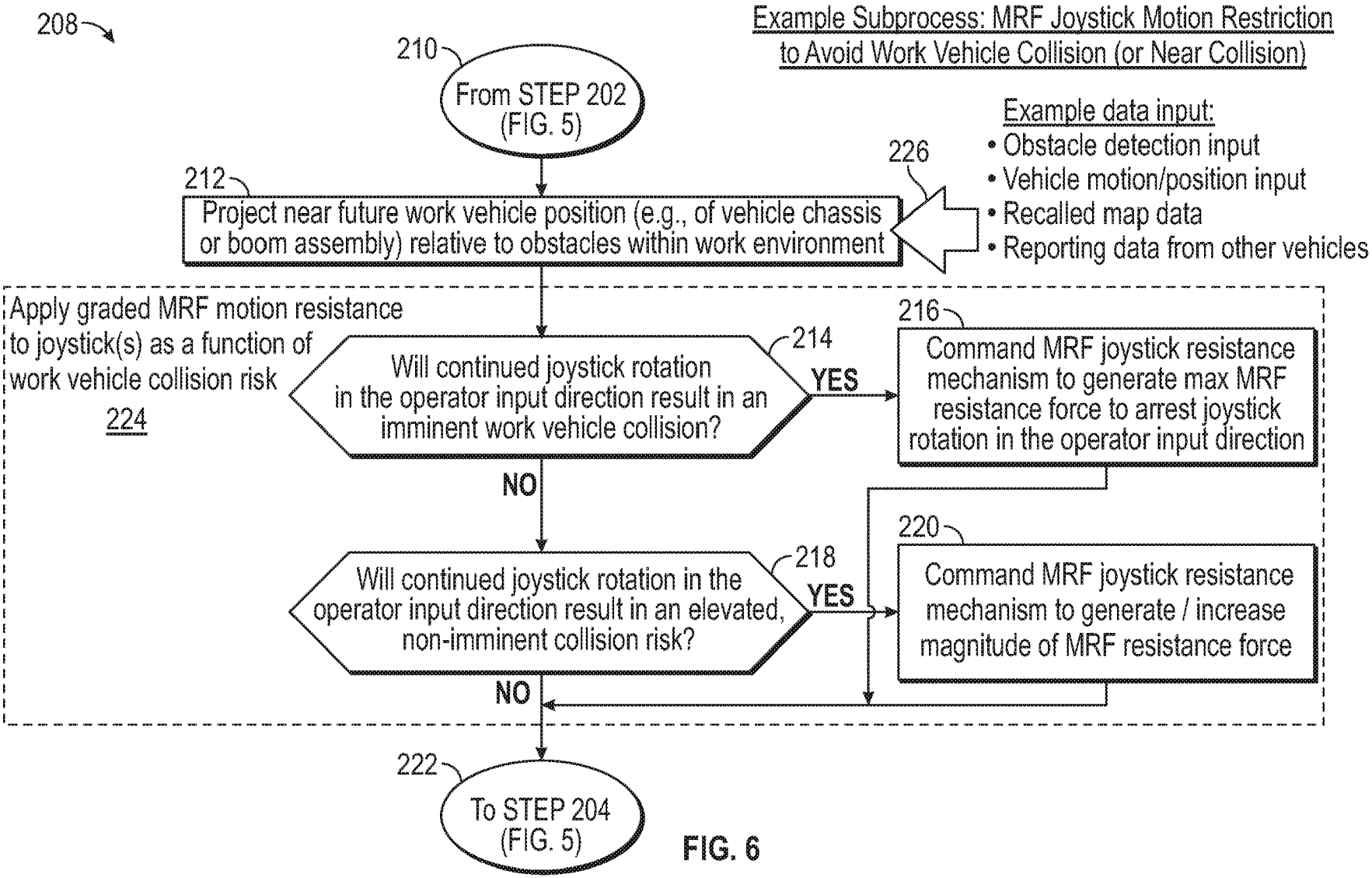
FIG. 6 is a flowchart of a first example subprocess suitably performed during the course of the master process of FIG. 5 to deter joystick motions increasing the likelihood of potential work vehicle collision.

Discussing next FIG. 6, a flowchart setting-forth an example collision avoidance subprocess 208 is presented. The collision avoidance subprocess 208 is suitably performed during the above-described master process 190 (FIG. 5) to selectively restrict joystick motions increasing the likelihood of work vehicle collision with neighboring obstacles, including collision of one portion of the work vehicle controlled through joystick motions (e.g., a boom assembly or blade) with another portion of the work vehicle (e.g., the work vehicle body or tires). As indicated at STEP 210, the collision avoidance subprocess 208 may begin following STEP 202 of the master process 190, with STEPS 212, 214, 216, 218, 220 generally corresponding to (that is, performed during) STEPS 196, 200 of the master process 190. Additionally, STEPS 214, 216, 218, 220 may be carried-out as part of a larger process block, which is performed by the controller architecture 50 (FIG. 1) to provide a range of MRF resistance forces impeding joystick motion as a function of the predicted likelihood or urgency of an impending work vehicle collision.

After commencing the collision avoidance subprocess 208, the controller architecture 50 advances to STEP 212 and projects the near future work vehicle position relative to any obstacles in proximity of the work vehicle. To render this projection, and as indicated in FIG. 6 by arrow 226, the controller architecture 50 may gather real-time data indicative of the location and movement of any known obstacles in proximity of the work vehicle. Such data may be provided by any number and type of obstacle data sources onboard the work vehicle. For example, and as discussed above in conjunction with the example excavator 20 depicted in FIG. 1, such obstacle data sources can include stored map data recalled from the memory 48 and marking the obstacle locations in the work environment within which the excavator 20 (or other work vehicle) operates. For example, in one approach, survey map data may be created ahead of the work task performed by the work vehicle (particularly, when the work vehicle is a construction, mining, or forestry vehicle), with such survey map data marking the location of obstacles within the work area and downloaded to the local memory 48 (or, perhaps, accessed by the controller architecture 50 over the datalink 80). Obstacle detection may also be furnished by any obstacle detection sensors onboard the work vehicle, such as sensors included in the above-described obstacle detection system 72. Work vehicle traffic or surveillance data, such as positioning data iteratively broadcast by other work vehicles in the vicinity of the work vehicle, may also be received by the work vehicle over a wireless datalink (e.g., the datalink 80) during STEP 212 in at least some embodiments.

In addition to the obstacle data described above, the controller architecture 50 further considers the current position and movement of the work vehicle during STEP 212 of the collision avoidance subprocess 208. Numerous models or algorithms exist for calculating or projecting future work vehicle position based upon the current position and movement state of the work vehicle, any of which may be employed in embodiments of the present disclosure. Generally, when the chassis of the work vehicle is in motion and controllable utilizing one or more MRF joystick devices, the controller architecture 50 considers the current motion vector of the work vehicle (e.g., speed and direction of travel), as determined from IMU data, GPS tracking, speed calculations, compass data, and other such data parameters, to estimate the position of the work vehicle in a future timeframe or lookahead window on the order of a few seconds or less. This projection may then be compared to the known obstacle locations and obstacle motion states (if applicable) to determine if continued joystick rotation in a particular direction (the operator input direction) will increase the likelihood of work vehicle collision to an undesirable or problematic level. A similar technique may likewise be utilized to predict the near future location of the boom assembly of a work vehicle. For example, and again referring to the example excavator 20 shown in FIG. 1, movement and posturing of the excavator boom assembly 24 may be tracked utilizing the above-described boom assembly tracking sensors, such as IMUs, inclinometers, rotary sensors, linear sensors, or the like, integrated into the boom assembly 24. Utilizing this data, the controller architecture 50 then determines, at STEP 212, whether an operator-controlled joystick motion, if permitted to continue unhindered, will increase the likelihood of work vehicle collision with any obstacle in the vicinity of the excavator 20; in this example, if a joystick rotation in an operator input direction will result in the boom assembly 24 striking a nearby obstacle (or potentially striking another portion of the excavator 20 itself) should the joystick rotation continue unabated. After rending this determination, the controller architecture continues to process block 224 of the collision avoidance subprocess 208.

During process block 224 of the collision avoidance subprocess 208, the controller architecture 50 commands the MRF joystick resistance mechanisms 56 to generate an MRF resistance force having a specified intensity or strength to deter further joystick rotation (or other joystick movement) in the operator input direction when predicted to result in an increased likelihood of work vehicle collision. First, at STEP 214 of the subprocess 208, the controller architecture 50 determines whether continued joystick rotation in the operator input direction will result in an imminent collision between the work vehicle and a nearby obstacle (or an imminent collision between two different portions of the work vehicle itself); e.g., in the case of the excavator 20, whether the excavator chassis 28 or the boom assembly 24 is anticipated to strike an neighboring obstacle in an immediate timeframe should joystick rotation continue in the detected operator input direction. If answering this query in the affirmative, the controller architecture 50 commands or controls the MRF joystick resistance mechanism 56 to generate a maximum MRF resistance force in an attempt to arrest further joystick rotation in the operator input direction. Additionally, any combination of visual, haptic, or audible alerts may be generated during STEP 216 concurrent with this application of the peak MRF resistance force to warn an operator of the potential of immediate collision with an obstacle; e.g., in the case of the excavator 20, a visual alert may be generated on a screen of the display device 82 in a striking color, such as red, along with a corresponding audible alert. Afterwards, the controller architecture 50 progresses to STEP 222 of the subprocess 208 and ultimately to STEP 204 of the master process 190 (FIG. 5).

If instead determining that an imminent collision risk is not posed by continued joystick rotation in the operator input direction (STEP 214), the controller architecture 50 progresses to STEP 218 of the subprocess 208 and evaluates whether continued joystick rotation in the operator input direction will result an undesirably elevated, non-imminent collision risk. If answering this query in the negative, the controller architecture 50 advances to STEP 222 and, therefore, to STEP 204 of the master process 190, as previously described. Otherwise, the controller architecture 50 progresses to STEP 220 and commands the MRF joystick resistance mechanism 56 to either: (i) initially generate an MRF resistance force deterring further rotation of the joystick in the operator input direction, or (ii) increase the magnitude of the MRF resistance force, if previously applied, to the extent that joystick rotation in the problematic direction continues. In this latter case, the MRF resistance force can be increased in a gradual (stepwise or continuous) manner. Alternatively, in other embodiments, the controller architecture 50 may control the MRF joystick resistance mechanism 56 such that the MRF resistance force is temporarily applied and then removed to create a tactile detent effect. If desired, such a detent effect can be repeatedly applied and, perhaps, intensified to create a pulsating effect should the operator continue to rotate the joystick in the operator input direction following initial application of the MRF resistance force by the MRF joystick system 22. This may provide a highly noticeable tactile cue to the operator of the increased susceptibility of the work vehicle to collision should the joystick rotation continue in the current direction. Following this, the controller architecture 50 progresses to STEP 204 of the subprocess 208 and ultimately to STEP 204 of master process 190 (FIG. 5) in the manner previously described. Finally, although not expressly called-out in the collision avoidance subprocess 208, it will be appreciated that the controller architecture 50 may command the MRF joystick resistance mechanism 56 to lessen or remove the MRF resistance force should the operator rotate the joystick in a second direction opposite the operator input direction at any point during the subprocess 208.

In determining whether continued joystick rotation in the operator input direction will result in an undesirable or elevated collision risk during STEP 218 of the subprocess 208, the controller architecture 50 may utilizing an approach employing virtual keep-out zones or a geofence in at least some embodiments of the present disclosure. In this regard, the memory 48 may store data defining the horizontal or planform dimensions of one or more keep-out zone or geofence settings; e.g., the radius of one or more circular keep-out zones, as seen from a top-down or planform viewpoint. The controller architecture 50 may then establish or construct, in a conceptual sense, the virtual keep-out zones (geofences) around all or selected obstacles within the proximity of the work vehicle. For example, in one relatively straightforward approach, the controller architecture 50 may establish a circular virtual keep-out zone around all detected (or otherwise known) obstacles, with the keep-out zone having a radius defined by a value stored in the memory 48; e.g., such a keep-out zone may range from, for example, 1-5 meters. In further embodiments, the keep-out zones or geofences may have more complex shapes and/or the controller architecture 50 may classify known obstacles and assign more expansive keep-out zones to obstacles classified as having higher protection statuses. Regardless of the particular approach employed, the controller architecture 50 may determine whether continued rotation of a joystick in an operator input direction will result in breach of a virtual keep-out zone by some portion of the work vehicle (potentially including any boom assembly attached to the work vehicle chassis); and, if so, the controller architecture 50 may command the MRF joystick resistance mechanism 56 to generate an MRF resistance force deterring continued rotation of the joystick in the operator input direction in the manner previously described.

Figure 7:
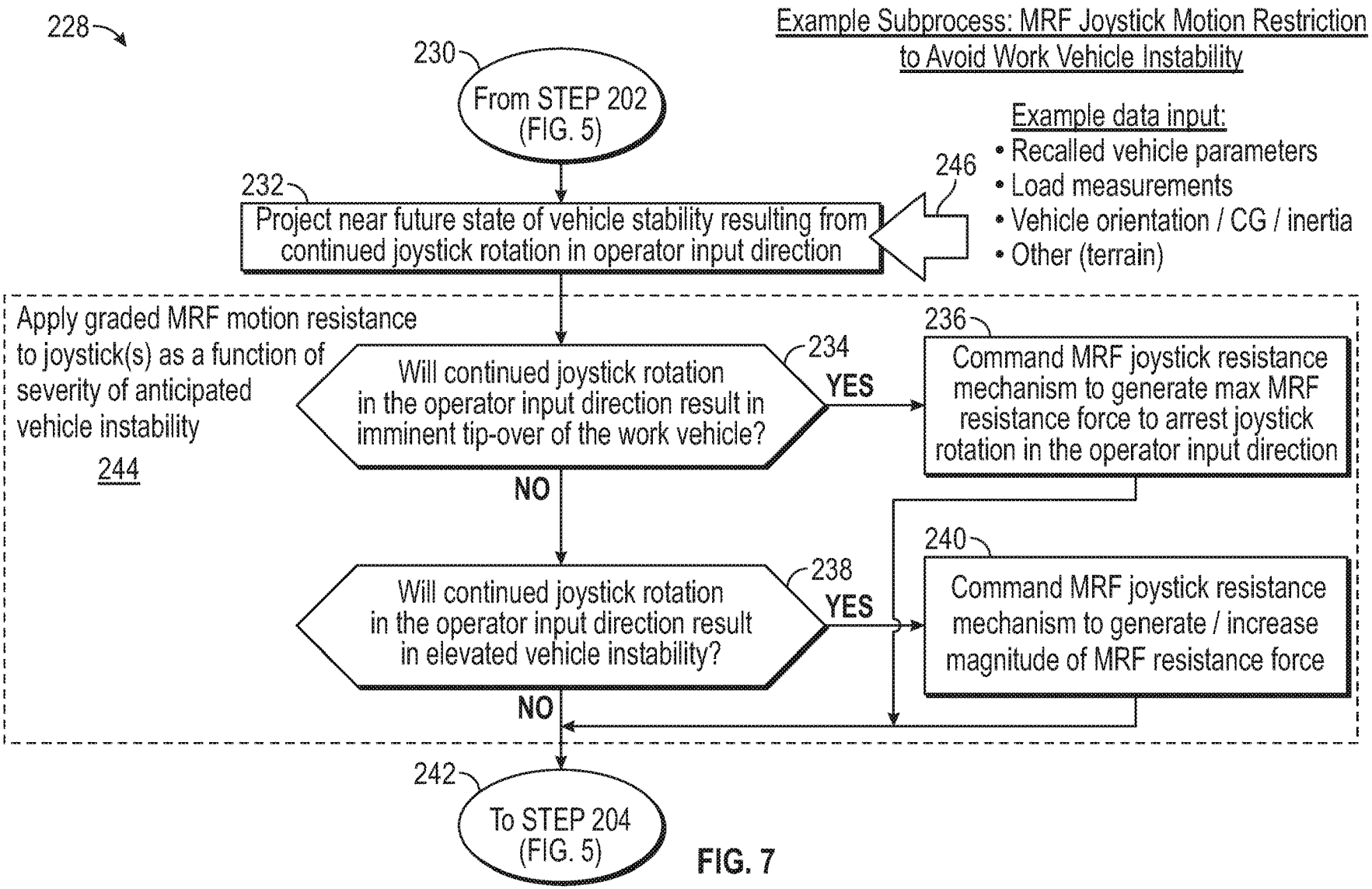
FIG. 7 is a flowchart of a second example subprocess suitably performed during the master process of FIG. 5 (in addition to or lieu of the subprocess of FIG. 6) to deter joystick motions increasing work vehicle instability.

Addressing lastly FIG. 7, there is shown a second example subprocess 228 suitably performed during the selective MRF joystick motion restriction process 190. The example subprocess 228 (hereafter, the "instability avoidance subprocess 228") can be performed in conjunction with or lieu of the example collision avoidance subprocess 208 described above in connection with FIG. 6. In a manner similar to the subprocess 208, and as indicated at STEP 230 of FIG. 7, the instability avoidance subprocess 228 commences following STEP 202 of the master process 190, with STEPS 232, 234, 236, 238, 240 generally corresponding to STEPS 196, 200 of the master process 190. Again, STEPS 234, 236, 238, 240 of the subprocess 224 may be performed as part of a larger process block, which, in this case, is carried-out by the controller architecture 50 (FIG. 1) to provide a range of MRF resistance forces as a function of the anticipated severity or immediacy of work vehicle instability. After the instability avoidance subprocess 228 commences, the controller architecture 50 projects the near future stability state of the work vehicle resulting from continued joystick motion in the operator input direction. As by arrow 246, the controller architecture 50 may consider data indicating a current motion state of the work vehicle as reported by, for example, IMUs or inclinometers onboard the work vehicle. Additionally or alternatively, in embodiments in which the work vehicle is equipped with a boom assembly, the controller architecture 50 may consider the current movement and posture of the boom assembly. As a more specific example, in the case of the excavator 20 (FIGS. 1-4), the controller architecture 50 may utilize data provided by the boom assembly tracking sensors (included in the sensors 74) to monitor joystick-commanded movements of the excavator boom assembly 24; and, during subsequent steps, to determine whether continued rotation of the joystick in a particular operator input direction will misposition the work vehicle in a manner increasing work vehicle instability based, as least in part, on the joystick-commanded movements of the boom assembly 24.

Additional parameters potentially considered during STEP 232 of the instability avoidance subprocess 228 include the orientation of the work vehicle chassis relative to gravity. Such chassis orientation data may be provided by a vehicle orientation data source onboard the work vehicle, such as an inclinometer or an IMU affixed to the work vehicle chassis; e.g., the previously-described chassis orientation sensors 74 in the case of the excavator 20. Similarly, local ground topology or gradients may be considered if known from sensors onboard the work vehicle or from map data, as stored in the memory 48 or received via datalink 80. Data pertaining to the physical characteristics of the work vehicle or a model of the work vehicle (or a part of the work vehicle, as such as a boom assembly) may also be recalled from the memory 48 during STEP 232, as appropriate. By way of non-limiting example, such recalled data may describe the dimensions of the wheel or track base of the work vehicle, other pertinent dimensions of the work vehicle, the CG of the work vehicle, a weight of the work vehicle, and similar parameters. In still further embodiments in which the work vehicle is equipped with a load-moving implement, such as a bucket (e.g., the bucket 26 of the excavator 20), a bed, or a tank, data provided by a load measurement sensor may be considered by the controller architecture 50. Such data may be utilized by the controller architecture 50 to estimate a current load carried by the load-moving implement. The controller architecture 50 may then further determine (during the subsequent steps of the subprocess 228) whether continued rotation of the joystick in the operator input direction will misposition the work vehicle in a manner increasing work vehicle instability based, as least in part, on the current load carried by the load-moving implement. In the case of the excavator 20, specifically, such a load measurement sensor may directly measure the load carried by the bucket 26 (or other implement attached to the terminal end of the boom assembly 24) at a given point in time; or, instead, may measure a parameter (e.g., a hydraulic pressure within the EH actuation system 44) from which the load carried by the bucket 26 may be estimated, as previously described. As a second example, in the case of an articulated dump truck or another work vehicle having a fillable bed or tank, the current load carried by the bed or tank of the work vehicle may be measured utilizing an onboard payload weight sensor.

Advancing next to process block 244 of the instability avoidance subprocess 228 (FIG. 7), the controller architecture 50 controls or commands the MRF joystick resistance mechanisms 56 to generate a resistance force deterring any further joystick rotation in the operator input direction determined to result in work vehicle instability. In this regard, at STEP 234 of the instability avoidance subprocess 228, the controller architecture 50 determines whether continued joystick rotation in the operator input direction will result in severe work vehicle instability, such as imminent tip-over or roll-over of the work vehicle. If so determining, the controller architecture 50 then commands the MRF joystick resistance mechanism 56 to generate a maximum MRF resistance force in an attempt to arrest further joystick rotation in the operator input direction. Concurrently, high level visual, haptic, or audible alerts may also be generated accompanying the application of the maximum MRF resistance force to rapidly draw the operator's attention to the impending work vehicle instability event. Afterwards, the controller architecture 50 progresses to STEP 222 of the subprocess 208 and ultimately to STEP 204 of the master process 190 (FIG. 5), as previously described.

If instead determining that an imminent tip-over risk is not posed by continued joystick rotation in the operator input direction at STEP 234 of the instability avoidance subprocess 228, the controller architecture 50 progresses to STEP 238 and evaluates whether continued joystick rotation in the operator input direction will result an undesirably elevated level of vehicle instability. If this is not the case, the controller architecture 50 advances to STEP 242 of subprocess 228. Conversely, if determining that continued joystick rotation in the operator input direction will result an undesirably-elevated level of vehicle instability, the controller architecture 50 progresses to STEP 240 and commands the MRF joystick resistance mechanism 56 to generate (or to increase) an MRF resistance force inhibiting further rotation of the joystick in the operator input direction. In particular, and as discussed above in connection with STEP 220 of the subprocess 208, the controller architecture 50 may control MRF joystick resistance mechanism 56 to: (i) initially generate an MRF resistance force deterring further rotation of the joystick in the operator input direction, or (ii) increase the magnitude of the MRF resistance force if previously applied, while joystick rotation in the problematic direction continues. With respect to romanette (ii), any of the various manners in which such MRF resistance force may be increased or modified, as described above in connection with STEP 220 of the collision avoidance subprocess 208; e.g., the MRF resistance force may be increased in a gradual or stepwise manner with continued rotation of the joystick in the operator input direction, or a tactile effect (e.g., a detent effect or a pulsating resistance effect) may be applied. Following the generation or increase of the MRF resistance force at STEP 240, the controller architecture 50 progresses to STEP 204 of the subprocess 208 and ultimately to STEP 204 of master process 190 (FIG. 5).

Figure 8:
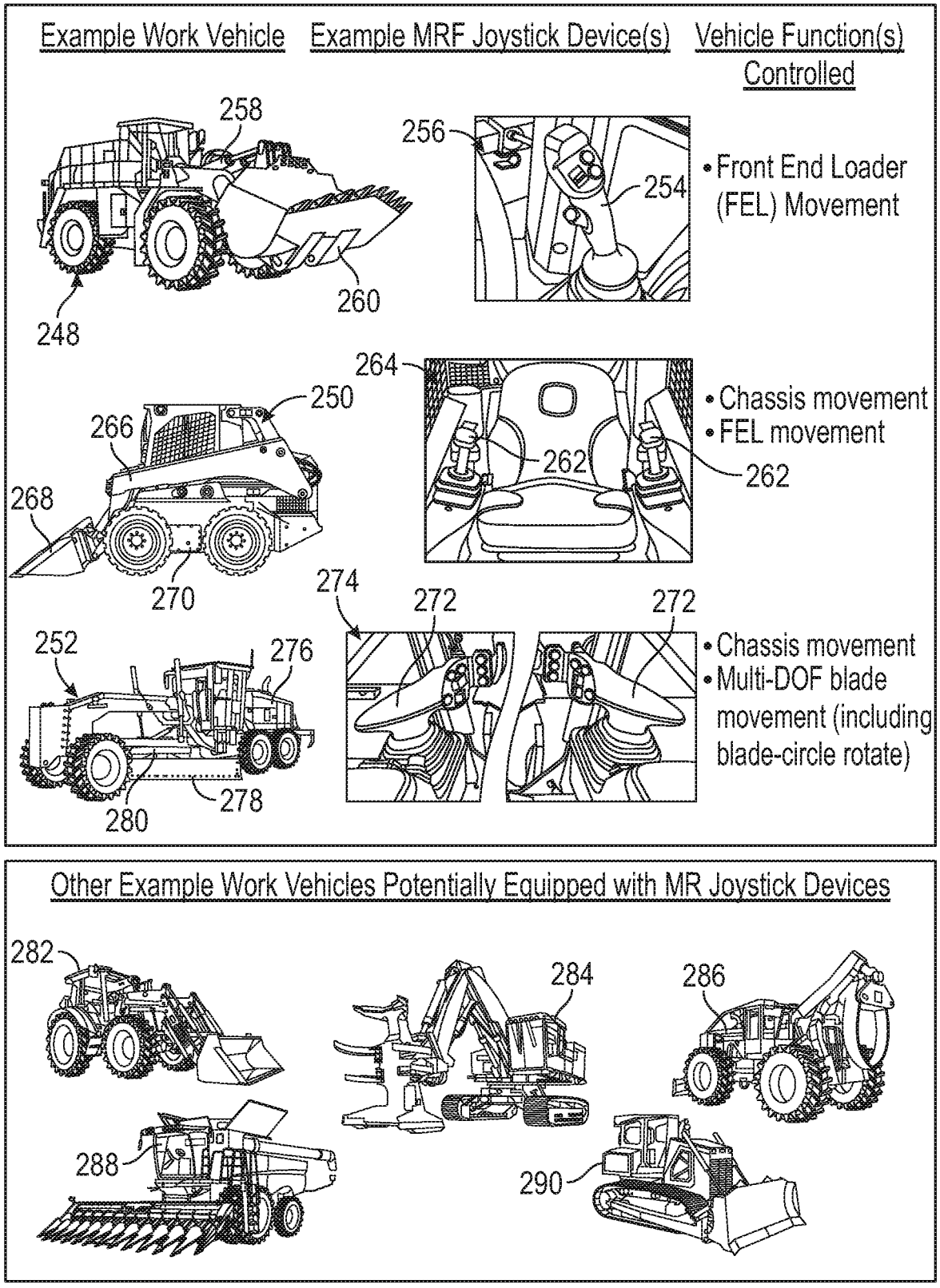
FIG. 8 is a graphic illustrating, in a non-exhaustive manner, additional example work vehicles into which embodiments of the MRF joystick system may be beneficially integrated.

Additional Examples of Work Vehicles Beneficially Equipped with MRF Joystick Systems The foregoing has thus described examples of MRF joystick systems configured to selectively restrict joystick motion to reduce work vehicle mispositioning resulting in work vehicle instability or an increased likelihood of work vehicle collision. While the foregoing description principally focuses on a particular type of work vehicle (an excavator) including a particular joystick-controlled work vehicle function (boom assembly movement), embodiments of the MRF joystick system described herein are amenable to integration into a wide range of work vehicles having various different joystick-controlled functions susceptible to work vehicle mispositioning. Three additional examples of such work vehicles are set-forth in the upper portion of FIG. 8 and include a wheeled loader 248, a skid steer loader (SSL) 250, and a motor grader 252. Addressing first the wheeled loader 248, the wheeled loader 248 may be equipped with an example MRF joystick device 254 located within the cabin 256 of the wheeled loader 248. As indicated in FIG. 8, the MRF joystick device 254 may be utilized to control the movement of a FEL 258 terminating in a bucket 260; the FEL 258, and front end loaders generally, considered a type of "boom assembly" in the context of this document. Comparatively, two MRF joystick devices 262 may be located in the cabin 264 of the example SSL 250 and utilized to control not only the movement of the FEL 266 and its bucket 268, but further control movement of the chassis 270 of the SSL 250 in the wheel known manner. Finally, the motor grader 252 likewise includes two MRF joystick devices 272 located within the cabin 274 of the motor grader 252. The MRF joystick devices 272 can be utilized to control the movement of the motor grader chassis 276 (through controlling a first transmission driving the motor grader rear wheels and perhaps a second (e.g., hydrostatic) transmission driving the forward wheels), as well as movement of the blade 278 of the motor grader; e.g., through rotation of and angular adjustments to the blade-circle assembly 280, as well as adjustments to the side shift angle of the blade 278.

In each of the above-mentioned examples, the MRF joystick devices can be controlled to inhibit (prevent or discourage) joystick motions predicted to result in work vehicle mispositioning, whether such mispositioning increases the likelihood of work vehicle collision (particularly in the case of the example SSL 250 and the example motor grader 252 in which operators are able to pilot the work vehicle through joystick motions), such mispositioning increases the likelihood of work vehicle instability (particularly in the case of the example wheeled loader 248 and the example SSL 250 having joystick-controlled boom assemblies and buckets), or both. With respect to the example motor grader 252, in particular, joystick motions of the MRF joystick devices 272 predicted to result in motor grader instability, collision (or near collision) of the motor grader with a nearby obstacle, and/or collision of the motor grader blade 278 with another portion of the of the motor grader 252 (e.g., the wheels, steps, or adjacent structure of the motor grader body) may be impeded by selective application of an MRF resistance force in a manner analogous to that previously described. Still further examples of work vehicles having joystick-controlled functions susceptible to work vehicle mispositioning are illustrated in a bottom portion of FIG. 8 and include an FEL-equipped tractor 282, a feller buncher 284, a skidder 286, a combine 288, and a dozer 290.

Enumerated Examples of the Work Vehicle MRF Joystick System

The following examples of the work vehicle MRF joystick system are further provided and numbered for ease of reference.

1. In embodiments, a work vehicle magnetorheological fluid (MRF) joystick system includes a joystick device, an MRF joystick resistance mechanism, and a controller architecture. The joystick device includes, in turn, a base housing, a joystick mounted to the base housing and movable with respect thereto, and a joystick position sensor configured to monitor joystick movement relative to the base housing. The MRF joystick resistance mechanism is at least partially integrated into the base housing and is controllable to selectively resist movement of the joystick relative to the base housing. The controller architecture is coupled to the MRF joystick resistance mechanism and to the joystick position sensor. The controller architecture configured to: (i) detect when an operator moves the joystick in an operator input direction; (ii) when detecting operator movement of the joystick in the operator input direction, determine whether continued joystick movement in the operator input direction will misposition the work vehicle in a manner increasing at least one of work vehicle instability and a likelihood of work vehicle collision; and (iii) when determining that continued joystick movement in the operator input direction will misposition the work vehicle, command the MRF joystick resistance mechanism to generate an MRF resistance force deterring continued joystick movement in the operator input direction.

2. The work vehicle MRF joystick system of example 1, wherein the work vehicle includes a boom assembly and boom assembly tracking sensors, while the controller architecture is coupled to the boom assembly tracking sensors. The controller architecture is configured to: (i) monitor a joystick-commanded of the boom assembly utilizing data provided by the boom assembly tracking sensors; and (ii) determine whether continued movement of the joystick in the operator input direction will misposition the work vehicle in a manner increasing work vehicle instability based, as least in part, on the joystick-commanded of the boom assembly.

3. The work vehicle MRF joystick system of example 1, wherein the work vehicle includes a load-moving implement and a load measurement sensor, while the controller architecture is coupled to the load measurement sensor. The controller architecture is configured to: (i) estimate a current load carried by the load-moving implement utilizing data provided by the load measurement sensor; and (ii) determine whether continued movement of the joystick in the operator input direction will misposition the work vehicle in a manner increasing work vehicle instability based, as least in part, on the current load carried by the load-moving implement.

4. The work vehicle MRF joystick system of example 1, wherein the work vehicle includes a work vehicle chassis and a vehicle orientation data source. The controller architecture is coupled to the vehicle orientation data source and is configured to: (i) estimate a current orientation of the work vehicle chassis relative to gravity utilizing data provided by the vehicle orientation data source; and (ii) determine whether continued joystick movement in the operator input direction will misposition the work vehicle in a manner increasing work vehicle instability based, as least in part, on the current orientation of the work vehicle chassis.

5. The work vehicle MRF joystick system of example 1, wherein the work vehicle includes an obstacle detection system configured to generate obstacle detection data indicating the location of obstacles proximate the work vehicle. The controller architecture is coupled to the obstacle detection system and is configured to determine whether continued joystick movement in the operator input direction will misposition the work vehicle in a manner increasing likelihood of work vehicle collision based, as least in part, on the obstacle detection data.

6. The work vehicle MRF joystick system of example 1, further including a memory storing map data obstacle positions in a work area within which the work vehicle operates. The controller architecture is coupled to the memory and is configured to determine whether continued joystick movement in the operator input direction will misposition the work vehicle in a manner increasing likelihood of work vehicle collision based, as least in part, on the stored map data.

7. The work vehicle MRF joystick system of example 1, wherein the work vehicle includes a datalink configured to receive work vehicle traffic data indicating locations of other work vehicles in the vicinity of the work vehicle. The controller architecture is coupled to the datalink and is configured to determine whether continued joystick movement in the operator input direction will misposition the work vehicle in a manner increasing a likelihood of work vehicle collision based, as least in part, on the work vehicle traffic data received via the datalink.

8. The work vehicle MRF joystick system of example 1, further including a memory storing keep-out zone data describing at least one horizontal dimension for a virtual keep-out zone. The controller architecture is coupled to the memory and is configured to: (i) establish a virtual keep-out zone around an obstacle in a vicinity of the work vehicle; and (ii) determine whether continued joystick movement in the operator input direction will misposition the work vehicle in a manner increasing a likelihood of work vehicle collision based, as least in part, on projected encroachment of the work vehicle into the virtual keep-out zone.

9. The work vehicle MRF joystick system of example 1, where the controller architecture is further configured to command the MRF joystick resistance mechanism to apply and lessen or remove the MRF resistance force to create a detent effect in response to continued joystick movement in the operator input direction.

10. The work vehicle MRF joystick system of example 1, wherein, following initial generation of the MRF resistance force, the controller architecture commands the MRF joystick resistance mechanism to remove or lessen the MRF resistance force in response to movement of the joystick in a second direction opposite the operator input direction.

11. The work vehicle MRF joystick system of example 1, wherein, following initial generation of the MRF resistance force, the controller architecture commands the MRF joystick resistance mechanism to increase a magnitude of the MRF resistance force in response to continued movement of the joystick in the operator input direction.

12. The work vehicle MRF joystick system of example 1, wherein the controller architecture is further configured to: (i) when detecting operator movement of the joystick in the operator input direction, determine whether collision of the work vehicle with an obstacle is imminent should joystick movement continue in the operator input direction; and (ii) if determining that collision of the work vehicle with an obstacle is imminent should joystick movement continue in the operator input direction, command the MRF joystick resistance mechanism to generate a maximum MRF resistance force to arrest continued joystick movement in the operator input direction.

13. The work vehicle MRF joystick system of example 1, wherein the controller architecture is further configured to: (i) when detecting operator movement of the joystick in the operator input direction, determine whether work vehicle tip-over is imminent should joystick movement continue in the operator input direction; and (ii) if determining that work vehicle work vehicle tip-over is imminent should joystick movement continue in the operator input direction, command the MRF joystick resistance mechanism to generate a maximum MRF resistance force to arrest continued joystick movement in the operator input direction.

14. The work vehicle MRF joystick system of example 1, wherein the joystick is rotatable relative to the base housing about a first axis and about a second axis perpendicular to the first axis. The MRF joystick resistance mechanism is controllable to independently vary first and second MRF resistance forces inhibiting rotation of the joystick about the first and second axes, respectively.

15. In further embodiments, the work vehicle MRF joystick system contains a joystick device including a joystick rotatable relative to a base housing, an MRF joystick resistance mechanism controllable to selectively resist rotation of the joystick relative to the base housing about at least one axis, and an obstacle detection system configured to detect obstacles within a proximity of the work vehicle. A controller architecture is coupled to the joystick device, to the MRF joystick resistance mechanism, and to the obstacle detection system. The controller architecture configured to: (i) in response to operator rotation of the joystick in an operator input direction, determine whether continued joystick rotation in the operator input direction will increase a likelihood of work vehicle collision with an obstacle proximate the work vehicle and detected by the obstacle detection system; and (ii) when determining that continued joystick rotation in the operator input direction will increase the likelihood of work vehicle collision, command the MRF joystick resistance mechanism to generate an MRF resistance force deterring continued joystick rotation in the operator input direction.

CONCLUSION

The foregoing has thus provided unique MRF joystick systems configured to intelligently restrict joystick motion to deter (that is, discourage or prevent) work vehicle mispositioning. Through the strategic application of MRF resistance forces impeding joystick motions projected to cause work vehicle mispositioning, embodiments of the MRF joystick system provides intuitive tactile cues to operators to slow, if not halt problematic joystick motions. Additionally, in instances in which the controller architecture commands the MRF joystick resistance mechanism to apply a maximum MRF resistance force, the MRF joystick system can potentially halt joystick motions to decrease the likelihood of, if not avoid high level collision risks or work vehicle tip-over. Concurrently, the MRF joystick resistance may be effectively transparent to a work vehicle operator under normal operating conditions when joystick motions do not risk mispositioning the work vehicle. The overall efficiency and safety of work vehicle operation may be enhanced as a result without detracting from operator experience when interfacing with one or more joysticks to control various functions of a particular work vehicle.

As used herein, the singular forms "a", "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A work vehicle magnetorheological fluid (MRF) joystick system for usage onboard a work vehicle, the work vehicle MRF joystick system comprising:

a joystick device, comprising:

a base housing;

a joystick mounted to the base housing and movable with respect thereto; and a joystick position sensor configured to monitor joystick movement relative to the base housing;

an MRF joystick resistance mechanism at least partially integrated into the base housing and controllable to selectively resist movement of the joystick relative to the base housing; and a controller architecture coupled to the MRF joystick resistance mechanism and to the joystick position sensor, the controller architecture configured to:

detect when an operator moves the joystick in an operator input direction;

when detecting operator movement of the joystick in the operator input direction, determine whether continued joystick movement in the operator input direction will misposition the work vehicle in a manner increasing at least one of work vehicle instability and a likelihood of work vehicle collision; and when determining that continued joystick movement in the operator input direction will misposition the work vehicle, command the MRF joystick resistance mechanism to generate an MRF resistance force deterring continued joystick movement in the operator input direction.

2. The work vehicle MRF joystick system of claim 1, wherein the work vehicle includes a boom assembly and boom assembly tracking sensors; and wherein the controller architecture is coupled to the boom assembly tracking sensors and is configured to:

monitor a joystick-commanded of the boom assembly utilizing data provided by the boom assembly tracking sensors; and determine whether continued movement of the joystick in the operator input direction will misposition the work vehicle in a manner increasing work vehicle instability based, as least in part, on the joystick-commanded of the boom assembly.

3. The work vehicle MRF joystick system of claim 1, wherein the work vehicle includes a load-moving implement and a load measurement sensor; and wherein the controller architecture is coupled to the load measurement sensor and is configured to:

estimate a current load carried by the load-moving implement utilizing data provided by the load measurement sensor; and determine whether continued movement of the joystick in the operator input direction will misposition the work vehicle in a manner increasing work vehicle instability based, as least in part, on the current load carried by the load-moving implement.

4. The work vehicle MRF joystick system of claim 1, wherein the work vehicle includes a work vehicle chassis and a vehicle orientation data source; and wherein the controller architecture is coupled to the vehicle orientation data source and is configured to:

estimate a current orientation of the work vehicle chassis relative to gravity utilizing data provided by the vehicle orientation data source; and determine whether continued joystick movement in the operator input direction will misposition the work vehicle in a manner increasing work vehicle instability based, as least in part, on the current orientation of the work vehicle chassis.

5. The work vehicle MRF joystick system of claim 1, wherein the work vehicle includes an obstacle detection system configured to generate obstacle detection data indicating locations of obstacles proximate the work vehicle; and wherein the controller architecture is coupled to the obstacle detection system and is configured to determine whether continued joystick movement in the operator input direction will misposition the work vehicle in a manner increasing likelihood of work vehicle collision based, as least in part, on the obstacle detection data.

6. The work vehicle MRF joystick system of claim 1, further comprising a memory storing map data identifying obstacles positions in a work area within which the work vehicle operates; and wherein the controller architecture is coupled to the memory and is configured to determine whether continued joystick movement in the operator input direction will misposition the work vehicle in a manner increasing likelihood of work vehicle collision based, as least in part, on the stored map data.

7. The work vehicle MRF joystick system of claim 1, wherein the work vehicle includes a datalink configured to receive work vehicle traffic data indicating locations of other work vehicles in a vicinity of the work vehicle; and wherein the controller architecture is coupled to the datalink and is configured to determine whether continued joystick movement in the operator input direction will misposition the work vehicle in a manner increasing a likelihood of work vehicle collision based, as least in part, on the work vehicle traffic data received via the datalink.

8. The work vehicle MRF joystick system of claim 1, further comprising a memory storing keep-out zone data describing at least one horizontal dimension for a virtual keep-out zone; and wherein the controller architecture is coupled to the memory and is configured to:

establish a virtual keep-out zone around an obstacle in a vicinity of the work vehicle; and determine whether continued joystick movement in the operator input direction will misposition the work vehicle in a manner increasing a likelihood of work vehicle collision based, as least in part, on projected encroachment of the work vehicle into the virtual keep-out zone.

9. The work vehicle MRF joystick system of claim 1, where the controller architecture is further configured to command the MRF joystick resistance mechanism to apply and lessen or remove the MRF resistance force to create a detent effect in response to continued joystick movement in the operator input direction.

10. The work vehicle MRF joystick system of claim 1, wherein, following initial generation of the MRF resistance force, the controller architecture commands the MRF joystick resistance mechanism to remove or lessen the MRF resistance force in response to movement of the joystick in a second direction opposite the operator input direction.

11. The work vehicle MRF joystick system of claim 1, wherein, following initial generation of the MRF resistance force, the controller architecture commands the MRF joystick resistance mechanism to increase a magnitude of the MRF resistance force in response to continued movement of the joystick in the operator input direction.

12. The work vehicle MRF joystick system of claim 1, wherein the controller architecture is further configured to:

when detecting operator movement of the joystick in the operator input direction, determine whether collision of the work vehicle with an obstacle is imminent should joystick movement continue in the operator input direction; and if determining that collision of the work vehicle with an obstacle is imminent should joystick movement continue in the operator input direction, command the MRF joystick resistance mechanism to generate a maximum MRF resistance force to arrest continued joystick movement in the operator input direction.

13. The work vehicle MRF joystick system of claim 1, wherein the controller architecture is further configured to:

when detecting operator movement of the joystick in the operator input direction, determine whether work vehicle tip-over is imminent should joystick movement continue in the operator input direction; and if determining that work vehicle work vehicle tip-over is imminent should joystick movement continue in the operator input direction, command the MRF joystick resistance mechanism to generate a maximum MRF resistance force to arrest continued joystick movement in the operator input direction.

14. The work vehicle MRF joystick system of claim 1, wherein the joystick is rotatable relative to the base housing about a first axis and about a second axis perpendicular to the first axis; and wherein the MRF joystick resistance mechanism is controllable to independently vary first and second MRF resistance forces inhibiting rotation of the joystick about the first and second axes, respectively.

15. A work vehicle magnetorheological fluid (MRF) joystick system for usage onboard a work vehicle, the work vehicle MRF joystick system comprising:

a joystick device including a joystick rotatable relative to a base housing;

an MRF joystick resistance mechanism controllable to selectively resist rotation of the joystick relative to the base housing about at least one axis;

an obstacle detection system configured to detect obstacles within a proximity of the work vehicle; and a controller architecture coupled to the joystick device, to the MRF joystick resistance mechanism, and to the obstacle detection system, the controller architecture having a processor and memory storing one or more computer programs executable by the processor to perform joystick control operations, including:

in response to operator rotation of the joystick in an operator input direction, determine whether continued joystick rotation in the operator input direction will increase a likelihood of work vehicle collision with an obstacle proximate the work vehicle and detected by the obstacle detection system; and when determining that continued joystick rotation in the operator input direction will increase the likelihood of work vehicle collision, command the MRF joystick resistance mechanism to generate an MRF resistance force deterring continued joystick rotation in the operator input direction.

16. The work vehicle MRF joystick system of claim 15, wherein the controller architecture is further configured to:

determine whether collision between the work vehicle and the detected obstacle is imminent should joystick rotation continue in the operator input direction; and if so determining, command the MRF joystick resistance mechanism to generate a maximum MRF resistance force to arrest continued joystick rotation in the operator input direction.

17. The work vehicle MRF joystick system of claim 15, wherein, following initial generation of the MRF resistance force, the controller architecture commands the MRF joystick resistance mechanism to gradually increase a magnitude of the MRF resistance force with continued rotation of the joystick in the operator input direction.

18. A work vehicle magnetorheological fluid (MRF) joystick system for usage onboard a work vehicle having a work vehicle chassis, the work vehicle MRF joystick system comprising:

a joystick device including a joystick rotatable relative to a base housing;

an MRF joystick resistance mechanism controllable to selectively resist rotation of the joystick relative to the base housing about at least one axis;

a vehicle orientation data source configured to estimate a current orientation of the work vehicle chassis relative to gravity; and a controller architecture coupled to the joystick device, to the MRF joystick resistance mechanism, and to the vehicle orientation data source, the controller architecture having a processor and memory storing one or more computer programs executable by the processor to perform joystick control operations, including:

in response to operator rotation of the joystick in an operator input direction, determine whether continued joystick rotation in the operator input direction will increase work vehicle instability based, at least in part, on the current orientation of the work vehicle chassis; and when determining that continued joystick rotation in the operator input direction will increase susceptibility of the work vehicle to collision with an obstacle, command the MRF joystick resistance mechanism to generate an MRF resistance force deterring continued joystick rotation in the operator input direction.

19. The work vehicle MRF joystick system of claim 18, wherein the controller architecture is further configured to:

determine whether work vehicle tip-over is imminent should joystick rotation continue in the operator input direction; and if so determining, command the MRF joystick resistance mechanism to generate a maximum MRF resistance force to arrest continued joystick rotation in the operator input direction.

20. The work vehicle MRF joystick system of claim 18, wherein the work vehicle includes a boom assembly and boom assembly tracking sensors; and wherein the controller architecture is coupled to the boom assembly tracking sensors and is configured to:

monitor a joystick-commanded of the boom assembly utilizing data provided by the boom assembly tracking sensors; and determine whether continued rotation of the joystick in the operator input direction will misposition the work vehicle in a manner increasing work vehicle instability based, as least in part, on the joystick-commanded of the boom assembly.

* * * * *